US009630227B2

(12) United States Patent
Weinzierl

(10) Patent No.: US 9,630,227 B2
(45) Date of Patent: Apr. 25, 2017

(54) OPERATING METHOD FOR A PRODUCTION LINE WITH PREDICTION OF THE COMMAND SPEED

(75) Inventor: Klaus Weinzierl, Nürnberg (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 722 days.

(21) Appl. No.: 13/696,376

(22) PCT Filed: Mar. 9, 2011

(86) PCT No.: PCT/EP2011/053513
§ 371 (c)(1),
(2), (4) Date: Nov. 6, 2012

(87) PCT Pub. No.: WO2011/138067
PCT Pub. Date: Nov. 10, 2011

(65) Prior Publication Data

US 2013/0054003 A1 Feb. 28, 2013

(30) Foreign Application Priority Data

May 6, 2010 (EP) ..... 10162135

(51) Int. Cl.
*G06F 19/00* (2011.01)
*B21B 37/74* (2006.01)
(Continued)

(52) U.S. Cl.
CPC ..... *B21B 37/74* (2013.01); *C21D 8/0226* (2013.01); *C21D 11/00* (2013.01); *C21D 11/005* (2013.01);
(Continued)

(58) Field of Classification Search
CPC ..... B21B 37/74; B21B 2261/20; B21B 37/46; B21B 2275/06; B21B 2275/04;
(Continued)

(56) References Cited

U.S. PATENT DOCUMENTS 4,785,646 A * 11/1988 Uekaji et al. ..... 72/8.5
5,724,842 A * 3/1998 Beattie ..... B21B 37/74 72/12.2
(Continued)

FOREIGN PATENT DOCUMENTS

CN 1114244 C 7/2003 ..... H01Q 21/28
CN 1589184 A 3/2005 ..... B21B 37/00
(Continued)

OTHER PUBLICATIONS

Chinese Office Action, Application No. 201180022850.6, 12 pages, Jun. 5, 2014.
(Continued)

*Primary Examiner* — Ziaul Karim
(74) *Attorney, Agent, or Firm* — Slayden Grubert Beard PLLC

(57) ABSTRACT

Before a first strip point is fed into a production line, an actual energy content at a location in front of the production line and a setpoint energy content at a location behind the production line are received for a first strip point, second strip point, and third strip point. The third strip point, followed by the first strip point, followed by the second strip point, are fed into the production line. A command variable for the first strip point and second strip point(s) is determined prior to feeding in the first strip point. Each command variable is determined based on (a) the actual value and the setpoint value of the strip point currently entering the production line, and (b) the actual value and the setpoint value of at least one strip point having already entered.

13 Claims, 9 Drawing Sheets

(51) Int. Cl.

| | |
|---|---|
| ***C21D 8/02*** | (2006.01) |
| ***C21D 11/00*** | (2006.01) |
| *B21B 37/00* | (2006.01) |
| *B21B 37/46* | (2006.01) |

(52) U.S. Cl.
CPC ..... *B21B 37/00* (2013.01); *B21B 37/46* (2013.01); *B21B 2261/20* (2013.01); *B21B 2275/02* (2013.01); *B21B 2275/04* (2013.01); *B21B 2275/06* (2013.01)

(58) Field of Classification Search
CPC ... B21B 2275/02; B21B 37/00; C21D 11/005; C21D 11/00; C21D 8/0226; B23Q 17/00
USPC ..... 700/153, 156; 29/407.05, 527.7
See application file for complete search history.

(56) References Cited

U.S. PATENT DOCUMENTS

| | | | | |
|---|---|---|---|---|
| 6,220,067 | B1 | 4/2001 | Sano | 72/8.5 |
| 6,362,788 | B1 | 3/2002 | Louzir | 343/700 MS |
| 7,197,802 | B2 | 4/2007 | Kurz et al. | 29/407.01 |
| 7,310,981 | B2 * | 12/2007 | Kurz | B21B 37/74 148/511 |
| 2004/0205951 | A1 * | 10/2004 | Kurz et al. | 29/407.05 |
| 2010/0211209 | A1 * | 8/2010 | Meissen | B21B 37/00 700/173 |
| 2013/0054003 | A1 | 2/2013 | Weinzierl | 700/153 |

FOREIGN PATENT DOCUMENTS

| | | | | |
|---|---|---|---|---|
| CN | 1753734 | A | 3/2006 | B21B 37/74 |
| DE | 10321791 | A1 | 12/2004 | B21B 37/74 |
| JP | 63168211 | A | 7/1988 | B21B 37/00 |
| RU | 2184632 | C2 | 7/2002 | B21B 37/74 |
| WO | 03/045599 | A1 | 6/2003 | B21B 37/00 |
| WO | 2011/138067 | A2 | 11/2011 | B21B 37/74 |

OTHER PUBLICATIONS

European Search Report, Application No. 10162135.7, 6 pages, Oct. 12, 2010.
International Search Report and Written Opinion, Application No. PCT/EP2011/053513, 8 pages, Nov. 9, 2011.

* cited by examiner

OPERATING METHOD FOR A PRODUCTION LINE WITH PREDICTION OF THE COMMAND SPEED

CROSS-REFERENCE TO RELATED APPLICATIONS

This application is a U.S. National Stage Application of International Application No. PCT/EP2011/053513 filed Mar. 9, 2011, which designates the United States of America, and claims priority to EP Patent Application No. 10162135.7 filed May 6, 2010. The contents of which are hereby incorporated by reference in their entirety.

TECHNICAL FIELD

The present disclosure relates to an operating method for a production line for rolling a strip,

- wherein an actual value and a setpoint value for a first strip point are known to a control computer for the production line at the latest at a time point when said first strip point of the strip is still situated in front of the production line,
- wherein the actual value is characteristic of the actual energy content of the first strip point and the setpoint value is characteristic of the setpoint energy content of the first strip point,
- wherein the actual value relates to a location in front of the production line and the setpoint value relates to a location behind the production line,
- wherein the control computer determines a command variable for the first strip point based on a determining rule before the first strip point is fed into the production line,
- wherein the control computer determines a command speed based on the command variable and operates the production line at the command speed at the time point when the first strip point is fed into the production line,
- wherein the actual value and the setpoint value of the strip point entering the production line are input into the determining rule for the command variable.

The present disclosure further relates to a computer program comprising machine code, which can be directly executed by a control computer for a production line for rolling a strip, and whose execution by the control computer causes the control computer to operate the production line in accordance with such an operating method.

The present disclosure further relates to a control computer for a production line for rolling a strip, said control computer being so designed as to operate the production line in accordance with such an operating method.

The present disclosure further relates to a production line for rolling a strip, said production line being equipped with such a control computer.

BACKGROUND

A hot strip mill normally includes at least a production line and a cooling section that is arranged behind the production line. Alternatively or in addition to the cooling section, a blooming train can be arranged in front of the production line if applicable, or a casting device can be arranged in front of the production line.

The production line comprises a number of roll stands. The number of roll stands can be decided as required. Provision is normally made for a plurality of roll stands, e.g. four to seven roll stands. However, just one single roll stand may also be present in specific cases. A setpoint reduction is specified for each reduction stage that is to be performed at each roll stand, irrespective of the number of roll stands. If a plurality of roll stands are present, setpoint tensions are usually specified for the feed and/or delivery sides. If only one roll stand is present, a setpoint tension may be specified for the feed and/or delivery side. However, this is not necessarily required.

One of the target values that must be maintained in a hot strip mill is the final rolling temperature, i.e. the temperature at which the strip is delivered from the production line. As an alternative to the final rolling temperature, it is also possible to use another variable describing the energy content of the strip at this location, e.g. the enthalpy. The target value should be maintained over the whole length of the strip if possible. The target value can either be constant or vary over the length of the strip.

In order to achieve the target value, the command speed of the production line is normally adjusted accordingly. The command speed is a speed from which the strip speed and the circumferential roll speeds occurring within the production line can be clearly determined, possibly in conjunction with the reductions and setpoint tensions that must be adjusted in the production line. For example, it can be a notional speed of the strip head or the rotational speed of the first roll stand in the production line. The command speed can be defined as a function of the location of the strip head, for example.

Further control elements may be provided in the form of inter-stand cooling devices and/or an induction furnace that is arranged in front of the production line. Like the cooling devices of the cooling section, these control elements act only locally on the strip. The presence of these further control elements is however of lesser significance in the context of the present disclosure. Of critical importance is the command speed (or a variable that is characteristic of the command speed, e.g. the mass flow) and the determination thereof.

As mentioned above, a cooling section is usually arranged behind the production line. In the cooling section, the strip is cooled to a coiler temperature (or coiler enthalpy) in a defined manner. The speed at which the strip passes through the cooling section is defined by the command speed. The adjustment of the cooling profiles that are required for the individual strip points is effected by tracking the strip points and activating control valves, which adjust the coolant volume flow, at the correct time in the cooling devices of the cooling section.

The control valves have considerable delay times in practice, often measuring several seconds. In order to allow the control valves to be activated at the correct time in advance, it is therefore necessary to know at the correct time in advance when a specific strip point will be situated in the region of influence of a specific cooling device. In order to be able to calculate exactly when a specific strip point enters and leaves this region of influence, it is necessary to know not only the momentary value of the command speed, but also the future profile of the command speed, at least in the context of the delay time of the control valves. In addition to this, the throughput time itself, i.e. the time required by the respective strip point to pass through the cooling section, also has an influence on the coiler temperature. The throughput time is obviously also influenced by the profile of the command speed.

The prior art discloses a simplified way of determining the command-speed profile. For example, provision is made for predefining an initial value at which the strip head is to pass through the production line. Provision is further made for predefining an acceleration ramp, over which the strip is accelerated to a final speed as soon as the strip head is delivered from the production line. In practice, this procedure is unsuitable for maintaining a predefined setpoint final rolling temperature (or a corresponding temperature profile) with great accuracy.

The prior art also discloses capturing the (actual) final rolling temperature and correcting the command speed in the sense of minimizing the deviation of the actual final rolling temperature from the predefined setpoint final rolling temperature. This correction can be effected by means of conventional control or (as described in e.g. DE 103 21 791 A1) by means of Model Predictive Control. Irrespective of the type of control (conventional or model predictive), the control intervention (i.e. the modification of the command speed) nonetheless takes place at the same time as the command speed is determined. As in the case of the non-controlled procedure, any prediction is limited to predefining an anticipated future acceleration ramp. It is not certain whether, based on the setpoint and actual values of the next control step, the predicted command speed will actually be accepted. Moreover, the prediction applies to a single control step due to the nature of the system.

Admittedly, this procedure is normally suitable in practice for maintaining a predefined setpoint final rolling temperature (or a corresponding profile) with great accuracy. However, this procedure does not allow the actual variation of the command speed in the next control step to be predicted in terms of direction or value. Any prediction is more of a guess than a true determination.

Moreover, even if the prediction were correct or at least approximately correct, it would be essentially restricted to a single control step according to the teaching of DE 103 21 791 A1. This would be wholly unsatisfactory for timely correction of the control signals for the control elements of the cooling section or of inter-stand cooling devices in the production line. As a result of the variation in the command speed, the coolant volumes that are deposited by the control elements of the cooling section are therefore not deposited on the strip points for which said coolant volumes were previously calculated. This causes deviations in the temperature (or the energy content) of the strip points at the end of the cooling section (e.g. at a coiler) from setpoint set values. The precise maintenance of the final rolling temperature in the prior art is therefore achieved at the cost of significant fluctuation of the coiler temperature, for example.

The prior European patent application 09 171 068.1 (filing date Sep. 23, 2009), unpublished at the filing date of the present application, describes a Model Predictive Control which controls both a production line and a cooling section by means of a prognosis. The mass flow is also predicted in this context. This approach requires coolant volumes that are output by control elements of the cooling section, in order to allow the mass flow to be determined. In addition, the mass flow is also always corrected immediately here. This approach therefore likewise fails to solve the problem of allowing a command-speed profile to be determined reliably in advance.

SUMMARY

In one embodiment, an operating method for a production line for rolling a strip is provided, wherein an actual value and a setpoint value for a first strip point, a number of second strip points and a number of third strip points of the strip are known in each case to a control computer for the production line at the latest at a time point when said first strip point of the strip is still situated in front of the production line, wherein the respective actual value is characteristic of the actual energy content of the respective strip point and the respective setpoint value is characteristic of the setpoint energy content of the respective strip point, this applying to each strip point, wherein the respective actual value relates to a location in front of the production line and the respective setpoint value relates to a location behind the production line, this applying to each strip point, wherein the second strip points are fed into the production line after the first strip point and the third strip points are fed into the production line before the first strip point, wherein the control computer determines a command variable in each case for the first strip point and at least a subset of the second strip points based on a determining rule that is specific to the respective strip point and before the first strip point is fed into the production line, wherein the respective command variable is characteristic of the command speed at which the control computer operates the production line at the time point when the respective strip point is fed into the production line, wherein the control computer determines the respective command speed based on the command variable that has been determined for the respective strip point, and operates the production line at the respective command speed at the time point when the respective strip point is fed into the production line, and wherein the actual value and the setpoint value of the strip point currently entering the production line at this time point, and the actual value and the setpoint value of at least one strip point that has already entered the production line at this time point, are input into the determining rule for the respective command variable.

In a further embodiment, the control computer determines each of the command variables based on a multiplicity of individual command variables, each individual command variable relates in each case to one of the strip points whose actual value and setpoint value are input into the determination of the respective command variable, the control computer determines the respective individual command variable for each strip point such that a respective expected value matches the corresponding setpoint value, and the respective expected value is characteristic of an expected energy content that the respective strip point would assume, at that location behind the production line to which the currently corresponding setpoint value relates, if the control computer were to operate the production line at a command speed corresponding to the individual command variable during the entire passage of the respective strip point through the production line.

In a further embodiment, for each strip point whose command variable is determined by the control computer, said control computer: determines an effective actual value based on the actual values that are input into the determination of the command variable for the respective strip point, determines an effective setpoint value based on the setpoint values that are input into the determination of the command variable for the respective strip point, determines an expected value that is characteristic of an expected energy content which the respective strip point would assume, at that location behind the production line to which the effective setpoint value relates, if the control computer were to operate the production line at a command speed corresponding to the command variable for the respective strip point during the entire passage of the respective strip point through the production line, and determines the command variable such that the expected value at that location behind the production line to which the effective setpoint value relates has the effective setpoint value.

In a further embodiment, when determining the command variables, the control computer initially estimates the command variables as provisional values; the control computer determines a respective expected value for the first strip point and at least a subset of the second and third strip points; each expected value is characteristic of an expected energy content that the respective strip point would assume, at that location behind the production line to which the currently corresponding setpoint value relates, if the control computer were to operate the production line at command speeds corresponding to the estimated command variables during the entire passage of the respective strip point through the production line; and the control computer varies the estimated command variables, thereby optimizing a target function into which the amounts of the differences between the expected values and the corresponding setpoint values are input.

In a further embodiment, a penalty term by means of which changes to the command speed are penalized is additionally input into the target function.

In a further embodiment, the control computer creates a data field beforehand, in which, for a multiplicity of possible command speeds and possible actual values, the control computer stores the expected value that is produced for the respective possible actual value in the case of the respective possible command speed, and the control computer determines the command variables for the strip points using the data field.

In a further embodiment, the control computer: determines, for at least a subset of the strip points, a respective expected value which is characteristic of an expected energy content that is expected for the respective strip point, at that location behind the production line to which the currently corresponding setpoint value relates, as a result of the command speeds at which the control computer operates the production line during the entire passage of the respective strip point through the production line; receives, after the passage of the respective strip point through the production line, a measured value which is characteristic of an actual energy content of the respective strip point at that location behind the production line to which the corresponding setpoint value relates; automatically adapts a model of the production line based on a comparison between the expected energy content and the actual energy content; and adapts the model of the production line by adding an offset to the actual values when the data field is used, scaling the command speeds using a scaling factor and/or adding an offset to said command speeds and/or adding an offset to the expected values that were determined using the data field.

In a further embodiment, the actual value and the setpoint value of those strip points that have already entered the production line are only input into the determination of each command variable if these strip points have not yet left the production line at the time point for which the respective command variable is determined.

In a further embodiment, for at least a subset of the strip points, the control computer: determines a respective expected value which is characteristic of an expected energy content that is expected for the respective strip point, at that location behind the production line to which the currently corresponding setpoint value relates, as a result of the command speeds at which the control computer operates the production line during the entire passage of the respective strip point through the production line; receives, after the passage of the respective strip point through the production line, a measured value which is characteristic of an actual energy content of the respective strip point at that location behind the production line to which the corresponding setpoint value relates; and automatically corrects at least a subset of the already determined command variables based on a comparison between the expected energy content and the actual energy content.

In a further embodiment, based on the comparison, the control computer automatically corrects only those command variables that were determined for the strip points having a minimal distance from the entrance to the production line at the time point of the correction.

In a further embodiment, the control computer or another control device uses the determined command variables to determine at least one further actuating variable, that said further actuating variable is delayed by a dead time and acts only locally on the strip, wherein the minimal distance is specified such that a time difference corresponding to the minimal distance is at least as long as the dead time.

In a further embodiment, the control computer or another control device uses the determined command variables to determine at least one further actuating variable; said further actuating variable is delayed by a dead time and acts only locally on the strip; and the first strip point and that subset of the second strip points for which the respective command variable was determined before the first strip point was fed into the production line correspond to a prediction horizon that is at least as long as the dead time.

In a further embodiment, the control computer concatenates the determined command variables or the corresponding command speeds by means of a spline, such that a command-speed profile produced by the concatenation is constant and differentiable.

In a further embodiment, the control computer performs the determination of the command variables in the context of a precalculation online or in real time.

In another embodiment, a computer program comprising machine code, which can be directly executed by a control computer for a production line for rolling a strip and whose execution by the control computer causes the control computer to operate the production line in accordance with an operating method having any or all of the steps disclosed above.

In another embodiment, a control computer for a production line for rolling a strip is provided, wherein the control computer is designed so as to operate the production line in accordance with an operating method having any or all of the steps disclosed above. In another embodiment, a production line for rolling a strip is equipped with such a control computer.

BRIEF DESCRIPTION OF THE DRAWINGS

Example embodiments will be explained in more detail below with reference to figures, in which.

DETAILED DESCRIPTION

Figure 1:
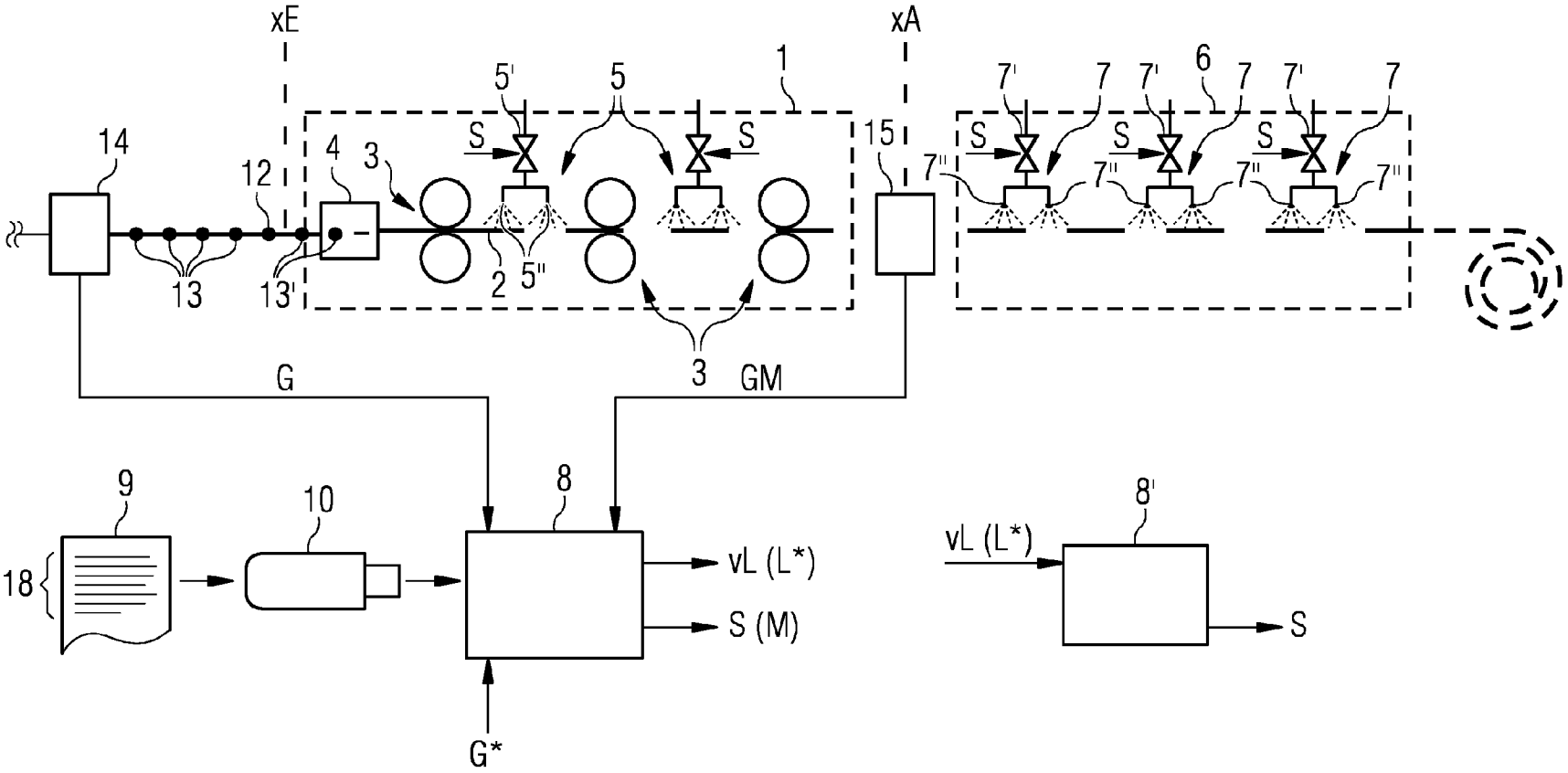
FIG. 1 shows a hot strip mill.

According to certain embodiments disclosed below, before a strip point is fed into the production line, the command variable can be determined reliably and realistically for not only this strip point but also for strip points that are fed into the production line after this strip point.

For example, in some embodiments provision is made for an actual value and a setpoint value for a first strip point, a number of second strip points and a number of third strip points of the strip to be known in each case to a control computer for the production line at the latest at a time point when said first strip point of the strip is still situated in front of the production line, for the respective actual value to be characteristic of the actual energy content of the respective strip point and the respective setpoint value to be characteristic of the setpoint energy content of the respective strip point, this applying to each strip point, for the respective actual value to relate to a location in front of the production line and the respective setpoint value to relate to a location behind the production line, this applying to each strip point, for the second strip points to be fed into the production line after the first strip point and the third strip points to be fed into the production line before the first strip point, for the control computer to determine a command variable in each case for the first strip point and at least a subset of the second strip points based on a determining rule that is specific to the respective strip point and before the first strip point is fed into the production line, for the control computer to determine a command speed in each case based on the command variable that has been determined for the respective strip point, and to operate the production line at the respective command speed at the time point when the respective strip point is fed into the production line, for the actual value and the setpoint value of the strip point currently entering the production line at this time point and the actual value and the setpoint value of at least one strip point that has already entered the production line at this time point to be input into the determining rule for the respective command variable.

For example, provision can be made for the control computer to determine each of the command variables based on a multiplicity of individual command variables, for each individual command variable to relate in each case to one of the strip points whose actual value and setpoint value are input into the determination of the respective command variable, for the control computer to determine the respective individual command variable for each strip point such that a respective expected value matches the corresponding setpoint value, and for the respective expected value to be characteristic of an expected energy content that the respective strip point would assume, at that location behind the production line to which the currently corresponding setpoint value relates, if the control computer were to operate the production line at a command speed corresponding to the individual command variable during the entire passage of the respective strip point through the production line.

When determining the respective command variable based on the respective multiplicity of individual command variables, the control computer can implement weighted or unweighted averaging, for example.

Alternatively, for each strip point whose command variable is determined by the control computer, provision can be made for the control computer to determine an effective actual value based on the actual values that are input into the determination of the command variable for the respective strip point, and to determine an effective setpoint value based on the setpoint values that are input into the determination of the command variable for the respective strip point, for the control computer to determine an expected value that is characteristic of an expected energy content which the respective strip point would assume, at that location behind the production line to which the effective setpoint value relates, if the control computer were to operate the production line at a command speed corresponding to the command variable for the respective strip point during the entire passage of the respective strip point through the production line, and for the control computer to determine the command variable such that the expected value at that location behind the production line to which the effective setpoint value relates has the effective setpoint value.

The control computer can also implement weighted or unweighted averaging here when determining the effective actual value and the effective setpoint value.

Alternatively, provision can also be made for the control computer initially to estimate the command variables as provisional values when determining the command variables, for the control computer to determine a respective expected value for the first strip point and at least a subset of the second and third strip points, for each expected value to be characteristic of an expected energy content that the respective strip point would assume, at that location behind the production line to which the currently corresponding setpoint value relates, if the control computer were to operate the production line at command speeds corresponding to the estimated command variables during the entire passage of the respective strip point through the production line, and for the control computer to vary the estimated command variables, thereby optimizing a target function into which the amounts of the differences between the expected values and the corresponding setpoint values are input.

In the last-mentioned alternative, provision may be made for a penalty term, by means of which changes to the command speed are penalized, to be input into the target function.

Irrespective of which of the three above-cited alternatives is adopted, the operating method disclosed herein may be very computation-intensive. In order to reduce the computing effort, provision may be made for the control computer beforehand to create a data field in which, for a multiplicity of possible command speeds and possible actual values, the control computer stores the expected value that is produced for the respective possible actual value in the case of the respective possible command speed, and for the control computer to determine the command variables for the strip points using the data field.

The operating method as described above already works very well. It can be improved even further if the control computer determines, for at least a subset of the strip points, a respective expected value which is characteristic of an expected energy content that is expected for the respective strip point, at that location behind the production line to which the currently corresponding setpoint value relates, as a result of the command speeds at which the control computer operates the production line during the entire passage of the respective strip point through the production line, receives, after the passage of the respective strip point through the production line, a measured value which is characteristic of an actual energy content of the respective strip point at that location behind the production line to which the corresponding setpoint value relates, and automatically adapts a model of the production line (1) based on a comparison between the expected energy content and the actual energy content, and adapts the model of the production line by adding an offset to the actual values when the data field is used, scaling the command speeds using a scaling factor and/or adding an offset to said command speeds and/or adding an offset to the expected values that were determined using the data field.

In one embodiment, the actual value and the setpoint value of those points that have already entered the production line are only input into the determination of each command variable if these strip points have not yet left the production line at the time point for which the respective command variable is determined. In particular, when determining the command variable for a specific strip point, it is possible to input the actual and setpoint values of all strip points that are situated in the production line at the time point when the specific strip point enters the production line.

The operating method as described above already works very well. It can be improved even further if, for at least a subset of the strip points, the control computer determines a respective expected value which is characteristic of an expected energy content that is expected for the respective strip point, at that location behind the production line to which the currently corresponding setpoint value relates, as a result of the command speeds at which the control computer operates the production line during the entire passage of the respective strip point through the production line, receives, after the passage of the respective strip point through the production line, a measured value which is characteristic of an actual energy content of the respective strip point at that location behind the production line to which the corresponding setpoint value relates, and automatically corrects at least a subset of the already determined command variables based on a comparison between the expected energy content and the actual energy content.

If the control computer compares the expected energy content with the actual energy content and corrects the command variables, said comparison could be performed by the computer for all of the strip points one after the other. However, it is sufficient to carry out the comparison for some of the strip points, e.g. for every third or every tenth strip point.

If the control computer corrects the command variables, it obviously takes the modified command-variable profile into comparison when determining expected values.

The control computer could perform the correction for all of the previously determined command variables. However, provision may be made for the control computer, based on the comparison, automatically to correct only those command variables that were determined for the strip points having a minimal distance from the entrance to the production line at the time point of the correction. In particular, this procedure may be advantageous if the control computer or another control device uses the determined command variables to determine at least one further actuating variable and said further actuating variable is delayed by a dead time and acts only locally on the strip. This procedure is optimal if the minimal distance is specified such that a time difference corresponding to the minimal distance is at least as long as the dead time.

In addition to correcting previously determined command variables, the control computer can obviously adapt the determining rule for as yet undetermined command variables. Depending on the situation of the specific case, the adaptation result can be taken into consideration already when determining further command variables of the same strip or only when determining command variables for subsequent strips.

The two last-named procedures, specifically "correcting previously determined command variables" on the one hand and "adapting the determining rule" on the other can be combined, for example, such that the control computer includes a model of the production line, said model being used to determine the temperature that is expected for a strip point on the delivery side of the production line if the respective strip point has a given temperature on the feed side of the production line and passes through the production line while the production line is operated at a given command speed. The model can be adapted immediately in this case. This corresponds to the adaptation of the determining rule. The command variable for at least one of the previously determined command variables is therefore determined again using the adapted model of the production line. This corresponds in terms of approach to the correction of the previously determined command variables. If applicable, a smooth transition can be made from the originally determined command variables to the newly determined command variables.

The operating method disclosed herein may thus represent a significant advance over conventional methods when the prediction horizon is relatively short, e.g., three to five strip points. The operating method disclosed herein may be particularly advantageous when the first strip point and that subset of the second strip points for which the respective command variable was determined before the first strip point was fed into the production line correspond to a prediction horizon that is at least as long as the dead time that applies when the further actuating variable acts on the strip. This may apply in particular when combined with the correction of the previously determined command variables, if the correction is likewise coordinated with the cited dead time.

In one embodiment, provision is further made for the control computer to concatenate the determined command variables or the corresponding command speeds using a spline, such that a command-speed profile produced by the concatenation is constant and differentiable. The resulting advantage takes the form of a smoother and more uniform operation of the production line. This applies in particular if the resulting command-variable profile is not only differentiable, but constantly differentiable.

The control computer may perform the determination of the command variables in the context of a precalculation online or in real time.

Other embodiments provide a computer program embodied such that the control computer performs an operating method comprising any or all of the steps disclosed herein.

Still other embodiments provide a control computer for a production line for rolling a strip, said control computer being programmed to execute such an operating method during operation.

Still other embodiments provide a production line for rolling a strip, said production line being equipped with such a control computer.

As shown in FIG. 1, a hot strip mill comprises at least one production line 1. The production line 1 is used to roll a strip 2. The strip 2 is usually a metal strip, e.g. a steel strip. Alternatively (instead of steel) the strip may comprise copper, brass, aluminum or another metal.

The production line 1 has a roll stand 3 or, as illustrated in FIG. 1, a plurality of roll stands 3 for the purpose of rolling the strip 2. Three such roll stands 3 are illustrated in FIG. 1. The actual number of roll stands 3 can be three as illustrated. Alternatively, the number may differ from three, upwards in particular. The number of roll stands 3 is normally four to eight, in particular five to seven. Only the working rolls (2-high) of the roll stands 3 are illustrated in FIG. 1. In addition to the working rolls, the roll stands 3 usually also include back-up rolls (4-high), and sometimes even intermediate rolls (6-high).

The production line 1 can feature a heating device 4, e.g. an induction furnace. If the heating device 4 is present, it is usually situated at the entrance of the production line 1. Alternatively or additionally, heating devices can also be present between the roll stands 3 in the same way as inter-stand cooling devices. If present, the heating device 4 is considered to be part of the production line 1 in the context of the present disclosure. Alternatively or in addition to the heating device 4, the production line 1 can feature inter-stand cooling devices 5. If the inter-stand cooling devices 5 are present, each inter-stand cooling device 5 is straddled by two of the roll stands 3. If present, they are part of the production line 1. Each inter-stand cooling device 5 features at least one control valve 5' and at least one spray nozzle 5".

Furthermore, a cooling section 6 can be arranged behind the production line 1. If the cooling section 6 is present, it features cooling devices 7. Each cooling device 7 features at least one control valve 7' and at least one spray nozzle 7".

The strip 2 is cooled using a liquid coolant (usually water with or without admixtures) by means of both the inter-stand cooling devices 5 and the cooling devices 7. The difference between the inter-stand cooling devices 5 and the cooling devices 7 of the production line 6 is that the cooling devices 7 are arranged behind the last roll stand 3 of the production line 1, while the inter-stand cooling devices 5 are arranged between two of the roll stands 3 in each case.

As shown in FIG. 1, the production line 1 is also equipped with a control computer 8. The control computer 8 is used at least to control the production line 1, i.e. the roll stands 3 and, if present, the heating device 4 and the inter-stand cooling devices 5. The control computer 8 can also control further devices if applicable, e.g. the cooling section 6 and its cooling devices 7. Alternatively, the cooling section 6 can be controlled by a different control device 8'.

The operation of the control computer 8 is specified by a computer program 9, which is supplied to the control computer 8 via a mobile data medium 10, for example. The mobile data medium 10 can be embodied as required, e.g. as a CD-ROM, a USB memory stick or an SD memory card. The computer program 9 is stored on the data medium 10 in machine-readable form, e.g. in electronic form.

The computer program 9 comprises machine code 11 by means of which the control computer 8 is programmed, and which can be directly executed by the control computer 8. The execution of the machine code 11 by the control computer 8 causes the control computer 8 to operate the production line 1 in accordance with an operating method that is explained in greater detail below. The programming by means of the computer program 9 therefore results in a corresponding embodiment of the control computer 8.

Figure 2:
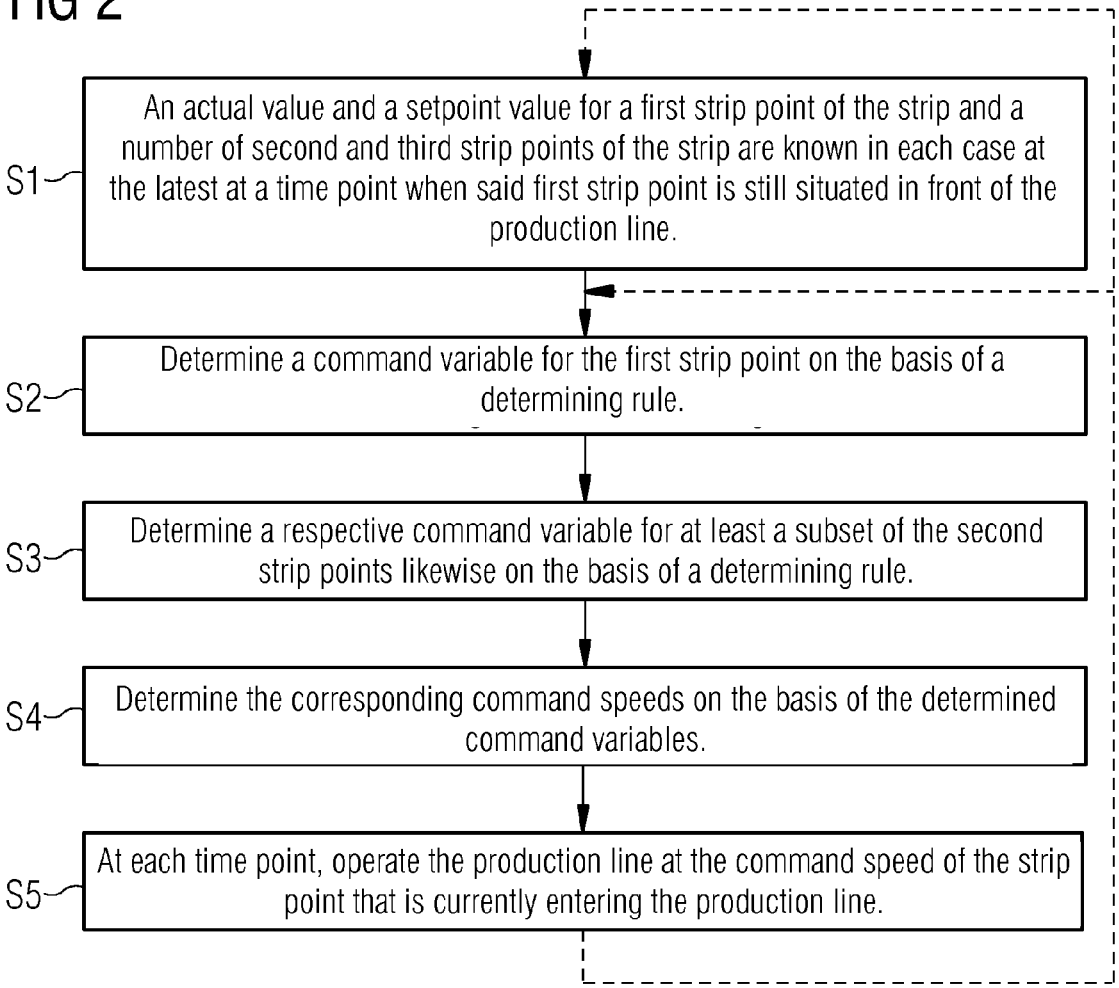
FIG. 2 shows a flow diagram.
Figure 3:
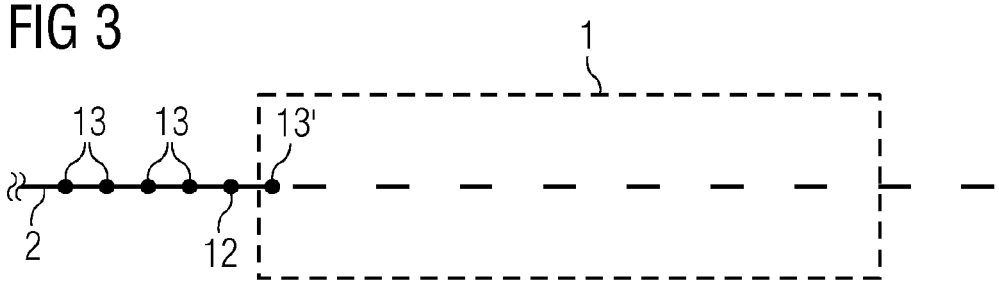
FIG. 3 to 6 show various exemplary states of a production line.
Figure 4:
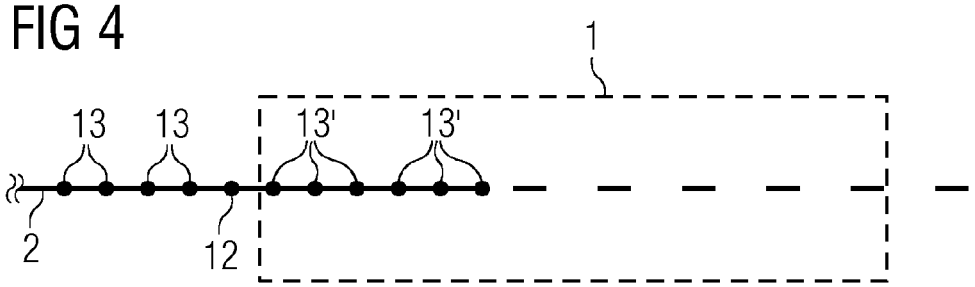
Figure 5:
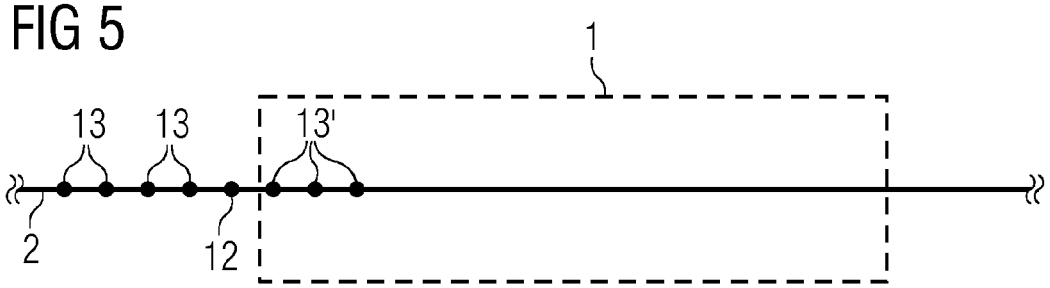
Figure 6:
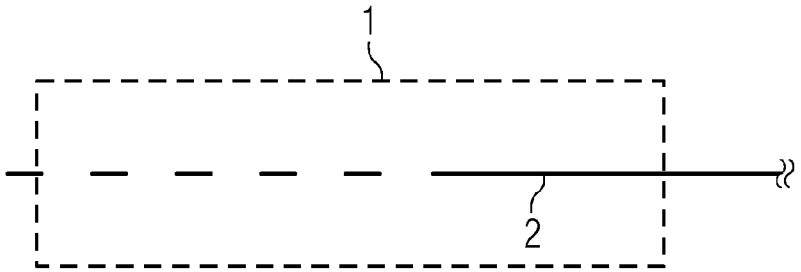

In the context of the operating method, in a step S1 according to FIG. 2, an actual value G and a setpoint value G* for a first strip point 12 of the strip 2, a number of second strip points 13 of the strip 2 and a number of third strip points 13' of the strip 2 must be known to the control computer 8 in each case, and at the latest at a time point when the first strip point 12 is still situated in front of the production line 1.

It will become clear from the following explanations that the actual values G and the setpoint values G* for the first strip point 12, the second strip points 13 and the third strip points 13' need not all become known to the control computer 8 at the same time. However, it will also become clear that they must all be known before the first strip point 12 is fed into the production line 1.

The second strip points 13 are all situated behind the first strip point 12, and therefore fed into the production line 1 after the first strip point 12. The third strip points 13' are fed into the production line 1 before the first strip point 12. Corresponding embodiments are shown in FIG. 3 to 6.

The actual value G of each strip point 12, 13, 13' is characteristic of the energy content that the respective strip point 12, 13, 13' has at a location xE in front of the production line 1. The actual value G therefore relates to the location xE in front of the production line 1. The location xE can be specified as required. In particular, as shown in FIG. 1 it can be a location that is situated immediately in front of the first device 4, 3 of the production line 1, by means of which the temperature of the strip 2 is directly or indirectly influenced. It is indeed also possible for a temperature measuring device to be arranged at this location. However, the temperature measuring device 14 is usually arranged in front of the location Xe.

The setpoint value G* of each strip point 12, 13, 13' is characteristic of the energy content that the respective strip point 12, 13, 13' will have at a location xA behind the production line 1. The setpoint values G* therefore relate to the location xA behind the production line 1. Like the location xE in front of the production line 1, the location xA can be specified as required. For example, it can be the location of a temperature measuring device 15 that is arranged behind the production line 1 but in front of the cooling section 6.

The type of the actual value G and the setpoint value G* can be specified as required. They usually relate to corresponding temperatures. Alternatively, they could relate in particular to an enthalpy.

For the sake of accuracy, it should be noted here that the term "location" in the following always refers to a location that is fixed relative to the production line 1. By contrast, the term "strip point" always refers to a point that is fixed relative to the strip 2. Distances between the strip points 12, 13, 13' are not determined by their geometric distances in the context of the present disclosure, since these distances change due to the rolling of the strip 2 in the production line 1. The distances are instead defined by the mass that is situated between the strip points 12, 13, 13'.

The strip points 12, 13, 13' can be equidistant with reference to the mass of the strip 2 that is situated between them. Alternatively, the strip points 12, 13, 13' can be defined by capturing in each case a measured value for the actual value G at temporally equidistant steps, e.g. by means of the temperature measuring device 14. The temporal distance between two consecutive strip points 12, 13, 13' is usually between 100 ms and 500 ms, typically between 150 ms and 300 ms. It may be 200 ms, for example.

In a step S2, the control computer 8 determines a command variable L* for the first strip point 12 based on a determining rule, this obviously occurring before the first strip point 12 is fed into the production line. In a step S3, the control computer 8 determines a respective command variable L* for at least a subset of the second strip points 13 likewise based on a determining rule. The step S3 is also performed by the control computer 8 before the first strip point 12 is fed into the production line 1.

The steps S2 and S3 from FIG. 2 generally form a single unit in practice. The separate representation in FIG. 2 merely serves to better explain the present disclosure.

In the context of the step S3, the control computer 8 may determine a respective command variable L* for all of the second strip points 13 that are situated within a predefined prediction horizon H relative to the first strip point 12. Therefore if a command variable L* is determined for a specific second strip point 13 in the context of the step S3, the respective command variables L* are normally also determined for all other second strip points 13 between the first strip point 12 and the specific second strip point 13.

The determined command variables L* are characteristic in each case of the command speed vL at which the control computer 8 operates the production line 1 when the strip point 12, 13 for which the respective command variable L* was determined is fed into the production line 1. For example, the command speed vL can be the speed at which the strip 2 is fed into the production line 1. Alternatively, it can be the speed at which the strip 2 is delivered from the production line 1. Other variables are also possible, e.g. specifying the mass flow or a rotational speed or circumferential speed of a roll. The essential provision is that all of the strip speeds and circumferential roll speeds occurring in the production line 1 are unambiguously specified by means of the command speed vL, possibly in conjunction with reductions and setpoint tensions.

In a step S4, the control computer 8 determines the corresponding command speeds vL based on the command variables L* if required. In a step S5, the control computer 8 operates the production line 1 in accordance with the command speeds vL that were determined in the step S4. Therefore the control computer 8 continuously adjusts the command speed vL such that at any time point the production line 1 is operated at precisely that command speed vL which corresponds to the command variable L* of the strip point 12, 13 currently entering the production line 1.

The determining rule for determining the command variables L* is specific to the respective strip point 12, 13 in each case. It is therefore not readily possible, from the determined value of the command variable L* for a specific strip point 12, 13, to deduce the value of the command variable L* for another strip point 12, 13. In particular, the actual value G and the setpoint value G* of the corresponding strip point 12, 13 are initially input into the determining rule for the command variable L* for a specific strip point 12, 13. The actual values G and the setpoint values G* of at least one further strip point 12, 13, 13', which has already entered the production line 1 at the time point when the examined strip point 12, 13 enters the production line 1, are also input into the respective determining rule. This fact is clearly explained below with reference to FIG. 7.

Figure 7:
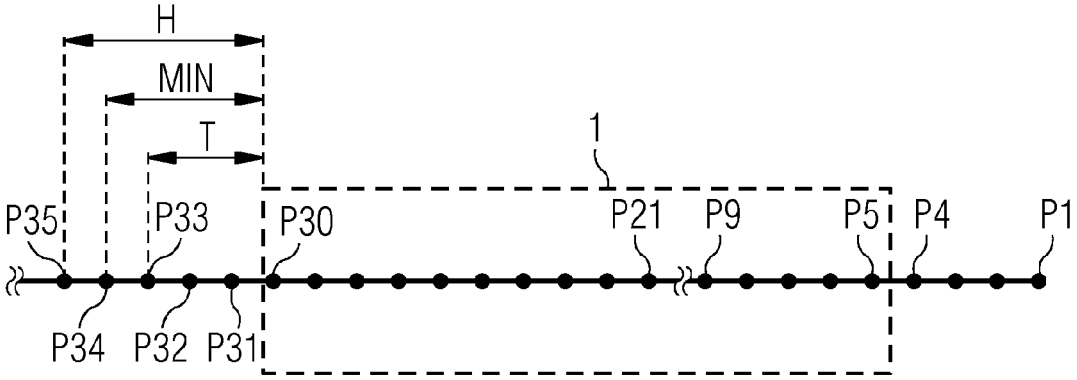
FIG. 7 shows an exemplary snapshot of the production line.

By way of example, FIG. 7 shows a snapshot of the production line 1 while the strip 2 is being rolled in the production line 1. In connection with the explanations for FIG. 7, the strip points 12, 13 are designated as strip points Pi (i=1, 2, 3, . . . ).

In accordance with the illustration in FIG. 7, it is assumed that the strip points P5 to P30 are currently in the production line 1. In this case, the strip points P1 to P4 have already emerged from the production line 1, and have therefore already left the production line 1 again. The strip points P31 to P35 are still in front of the production line 1. In this case, the strip point P31 will enter the production line 1 next. After the strip point P31, the strip points P32, P33, P34 and P35 will enter the production line 1 consecutively. It is assumed that the actual and setpoint values G, G* as far as and including the strip point P35 are known.

In the situation illustrated in FIG. 7, the determination of the command variable L* for the strip point P4 must already have been completed some time ago, since the strip point P4 has not only already entered the production line 1, but has actually already left the production line 1 again. The command variable L* that was used to operate the production line 1 at the time point when the strip point P4 entered the production line 1 may be determined using inputs as follows:

- the actual value G and the setpoint value G* for the strip point P4, and
- the actual value and the setpoint value G, G* for at least one of the strip points P1, P2 and P3.

Assuming that the prediction horizon H corresponds to four strip points, the determination of the command variable L* for the strip point P4 must have been completed one time cycle before the time point when the strip point P1 entered the production line 1.

Similarly, the command variable L* for the strip point P7 was determined using inputs as follows:

- the actual value and the setpoint value G, G* for the strip point P7, and
- the actual value and the setpoint value G, G* for at least one of the strip points P1 to P6.

This determination must have been completed at the latest at the time point of the entry of the strip point P3.

The strip point P30 is the strip point that has just entered the production line 1. The determination of the command variable L*, which must have been completed at the latest at the time point of the entry of the strip point P26, used inputs as follows:

- the actual value and the setpoint value G, G* for the strip point P30, and
- the actual value and the setpoint value G, G* for at least one of the strip points P1 to P29.

As a rule, for the purpose of determining the command variable L* for the strip point P30, it is sufficient to consider the actual and setpoint values G, G* of the strip points P5 to P30, i.e. those strip points which are currently situated in the production line 1 according to the illustration in FIG. 7.

The command variables L* for the strip points P31 to P35 are specified similarly. In the illustration according to FIG. 7, the strip point P31 corresponds to the first strip point 12, and the strip points P32 to P35 correspond to the second strip points 13. The determination of the command variables L* for these strip points P31 to P35 must be completed at the latest at the time point when the strip points P27 to P31 respectively enter the production line 1. The strip points P1 to P30 correspond to the third strip points 13'.

The command variable L* for the strip point P31 is determined using inputs as follows:

- the actual value and the setpoint value G, G* for the strip point P31, and
- the actual and setpoint values G, G* for at least one of the strip points P1 to P30, e.g., for at least one of the strip points P6 to P30.

The latter applies in particular because the strip points P1 to P5 have already left the production line 1 again at the time point when the strip point P31 enters the production line 1.

The command variables L* for the strip points P32 to P35 can be specified in a similar manner. For example, the command variable L* for the strip point P35 is determined using inputs as follows:

- the actual value and the setpoint value G, G* for the strip point P35 and
- the actual and setpoint values G, G* for at least one of the strip points P1 to P34.

The actual and setpoint values G, G* for the strip points P1 to P9 can be ignored in this case, because the strip points P1 to P9 have already left the production line 1 again at the time point when the strip point P35 enters the production line 1.

Similar explanations apply to the remaining strip points P32, P33 and P34.

In one embodiment, the command variable L* for each strip point 12, 13 entering the production line 1, e.g. for the strip point P31 according to FIG. 7, is therefore specified based on the actual and setpoint values G, G* of those strip points 12, 13, 13' which are currently situated in the production line 1 at this time point, i.e. have not yet left the production line 1.

A multiplicity of strip points 12, 13, 13' are usually situated in the production line 1 concurrently. They typically number between 10 and 200, e.g. between 50 and 100. Of the strip points 12, 13, 13' that are currently situated in the production line 1 at a specific time point, it is possible to consider only a subset of strip points 12, 13, 13', e.g. every second or every fourth strip point 12, 13, 13'. This procedure produces a reduced computing effort and gives results that are nonetheless acceptable. However, the determination of the command variable L* for a specific strip point 12, 13 may take into consideration the actual and setpoint values G, G* of all of the strip points 12, 13, 13' that are already situated in the production line 1 at the time point when the strip point 12, 13 whose command variable L* is being determined enters the production line 1.

It is obvious that the illustration shown in FIG. 7 is purely exemplary. Therefore e.g. the number of (third) strip points 13' situated in the production line 1 is purely exemplary. The number of (second) strip points 13, whose command variable L* is being predicted (the strip points P32 to P35 here), is likewise purely exemplary. The prediction horizon H is also purely exemplary. In particular, the prediction horizon H can be some seconds in practical applications, wherein a time cycle of e.g. 200 ms per capture of the actual value G as a measured value signifies a five-fold number of strip points 12, 13 correspondingly. A prediction horizon H of up to a minute and more is even possible in some cases, corresponding to a prediction horizon H of 300 strip points and more in the case of a time cycle of 200 ms.

It is possible for the actual and setpoint values G, G* for all strip points 12, 13, 13' of the (entire) strip 2 to be known to the control computer 8 in the step S1 from FIG. 2. In this case, it is possible for the control computer 8 to process the steps S2 and S3 only once, and to determine the command variables L* of all strip points 12, 13, 13' of the strip 2 in the steps S2 and S3 in a single stroke, so to speak. In this case, the control computer 8 performs the determination of the command variables L* in the context of a precalculation online.

Alternatively, it is possible for the actual and setpoint values G, G* for all strip points 12, 13, 13' of the entire strip 2 to be known to the control computer 8 in the context of the step S1 from FIG. 2, but for the control computer 8 only ever to determine the command variables L* for some of the strip points 12, 13, 13' in the steps S2 and S3 from FIG. 2. In this case, the steps S2 and S3 are integrated into a loop as indicated by a broken line in FIG. 2. In this case, the control computer 8 performs the determination of the command variables L* in real time with the activation of the production line 1. In this case, the control computer 8 determines the command variables L* in advance as far as the prediction horizon H, so to speak.

As indicated likewise by a broken line in FIG. 2, it is even possible for the step S1 also to be integrated into the loop. In this case also, the control computer 8 performs the determination of the command variables L* in real time.

If the step S1 is also integrated into the loop, only the actual and setpoint values G, G* of strip points 12, 13 that have not yet entered the production line 1 are known to the control computer 8 during a specific pass through the loop. The actual and setpoint values G, G* of the strip points 13' that have already been fed into the production line 1 are nonetheless known to the control computer 8 in this case due to previous passes through the loop. In this case, it is therefore only necessary for the control computer 8 to "remember" the "old" actual and setpoint values G, G*.

Various procedures can be used when determining the command variables L* for a specific strip point 12, 13, i.e. when implementing the steps S2 and S3 from FIG. 2. The various alternatives are explained in greater detail below in turn with reference to the FIGS. 8, 9 and 10. FIG. 7 should also be referred to in this context if required.

Figure 8:
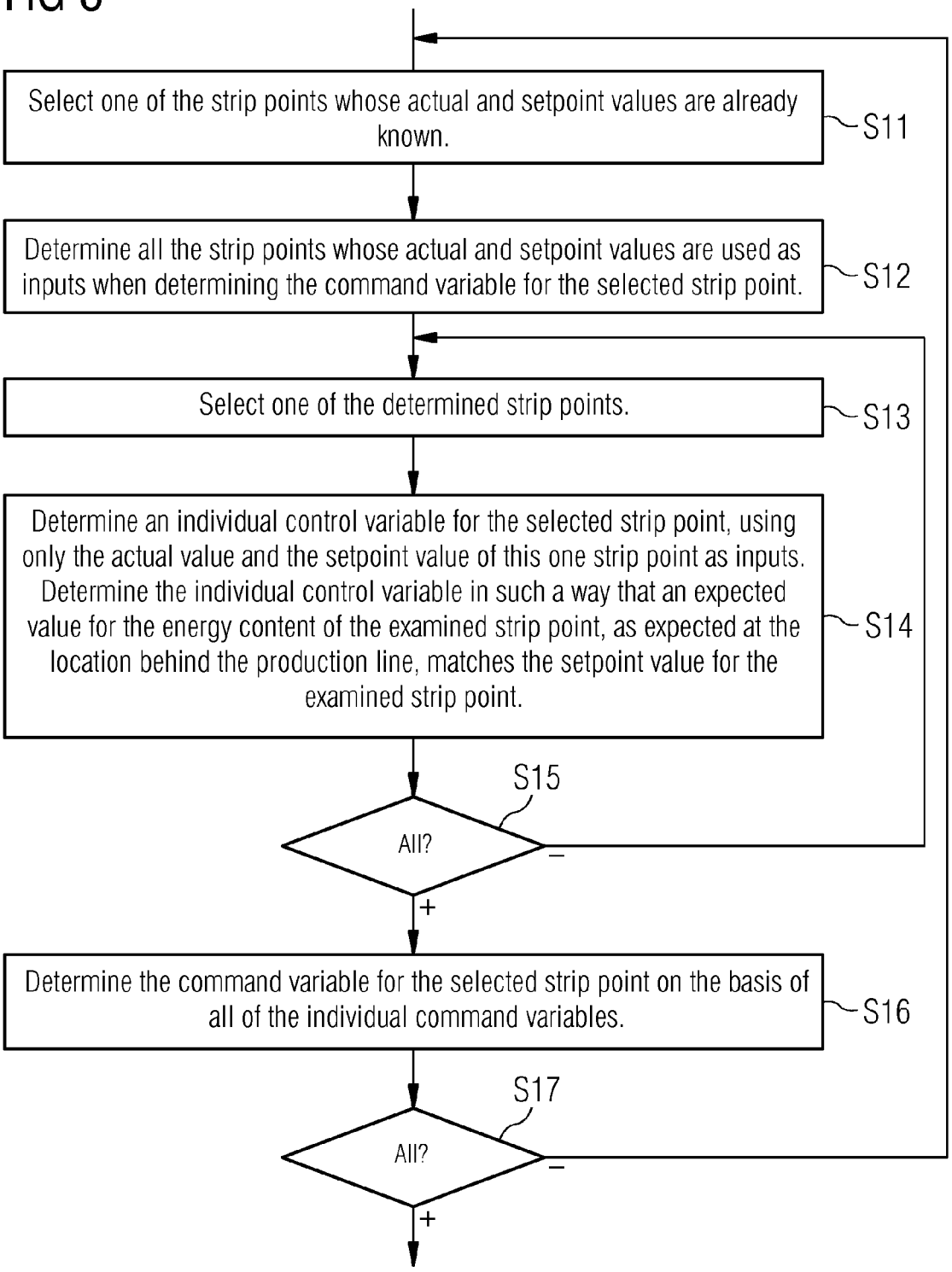
FIG. 8 to 11 show flow diagrams.

In a first possible embodiment of the steps S2 and S3 from FIG. 2, one of the strip points 12, 13 whose actual and setpoint values G, G* are already known to the control computer 8 is initially selected by the control computer 8 in a step S11 according to FIG. 8. For example, the control computer 8 selects the strip point P31 from FIG. 7.

In a step S12, the control computer 8 determines all of the strip points 12, 13, 13' whose actual and setpoint values G, G* are used as inputs when determining the command variable L* for the strip point 12, 13 which the control computer 8 selected in the step S11. For example, the control computer 8 can determine the strip points P6 to P31 for the strip point P31 (see FIG. 7). Similarly, the control computer in the step S12 would determine e.g. the strip points P7 to P32 for the strip point P32, the strip points P8 to P33 for the strip point P33, etc.

In a step S13, the control computer 8 selects one of the strip points 12, 13, 13' that was determined in the step S12. In a step S14, the control computer 8 determines an individual command variable l* for the strip point 12, 13, 13' that was selected in the step S13, e.g. for the strip point P6. Only the actual value G and the setpoint value G* of the strip point 12, 13, 13' that was selected in the step S13 are used as inputs for determining the individual command variable l*. The respective individual command variable l* therefore relates to this one strip point 12, 13, 13'.

The individual command variable l* specifies a corresponding command speed vL. The control computer 8 assumes that the strip point 12, 13, 13' examined in the step S14 is passing through the production line 1, and the production line 1 is operated constantly at this command speed vL, specified by the corresponding individual command variable l*, during the entire passage of the examined strip point 12, 13, 13' through the production line 1, i.e. from the time point when it is fed into the production line 1 until the time point when it is delivered from the production line 1. An energy content to which the setpoint value G* of the examined strip point 12, 13, 13' relates is expected for the examined strip point 12, 13, 13' at the location xA in this case. The control computer 8 determines this expected energy content. The expected energy content can be determined by the control computer 8 by means of a production line model, for example. Suitable production line models as such are known. They are used to determine the final rolling temperature, for example, as per DE 103 21 791 A1 cited above.

The expected energy content is characterized by a corresponding expected value GE. The expected value GE can be either the temperature or the enthalpy, in the same way as the actual and setpoint values G, G*. The control computer 8 determines the individual command variable l* for the examined strip point 12, 13, 13' in the step S14 such that the expected value GE matches the setpoint value G* for the examined strip point 12, 13, 13'.

In a step S15, the control computer 8 checks whether it has already performed the step S14 for all of the relevant strip points 12, 13, 13'. If this is not the case, the control computer 8 returns to the step S13. When the step S13 is performed again, the control computer 8 obviously selects a different and previously unexamined strip point 12, 13, 13' that is to be used as an input for determining the required command variable L*, e.g. the strip point P7.

If in the step S15 the control computer 8 finds that it has already determined all of the required individual command variables l*, the control computer 8 moves on to a step S16. In the step S16, based on all of the individual command variables l* it determined during the repeated execution of the step S14, the control computer 8 determines the command variable L* for the strip point 12, 13 that was selected in the step S11. For example, the control computer 8 can form the weighted or unweighted average of the individual command variables l*.

In a step S17, the control computer 8 checks whether it has already performed the steps S11 to S16 for all of the strip points 12, 13 whose command variables L* are to be calculated. If this is not the case, the control computer 8 returns to the step S11. There the control computer 8 obviously selects a different and previously unexamined strip point 12, 13. Otherwise, the method according to FIG. 8 ends.

In practice, the procedure according to FIG. 8 is implemented in a slightly different manner to that described above, as the individual command variable l* for a specific strip point 12, 13, 13' (e.g. for the strip point P28 in FIG. 7) is used as an input when determining the command variable L* for a plurality of strip points 12, 13, 13', e.g. when determining the strip points P28, P29, . . . P53 in the context of FIG. 7. It is obviously possible and may even be preferable to determine and then store the respective individual command variable l* just once, such that it can simply be retrieved from the memory for subsequent use.

Figure 9:
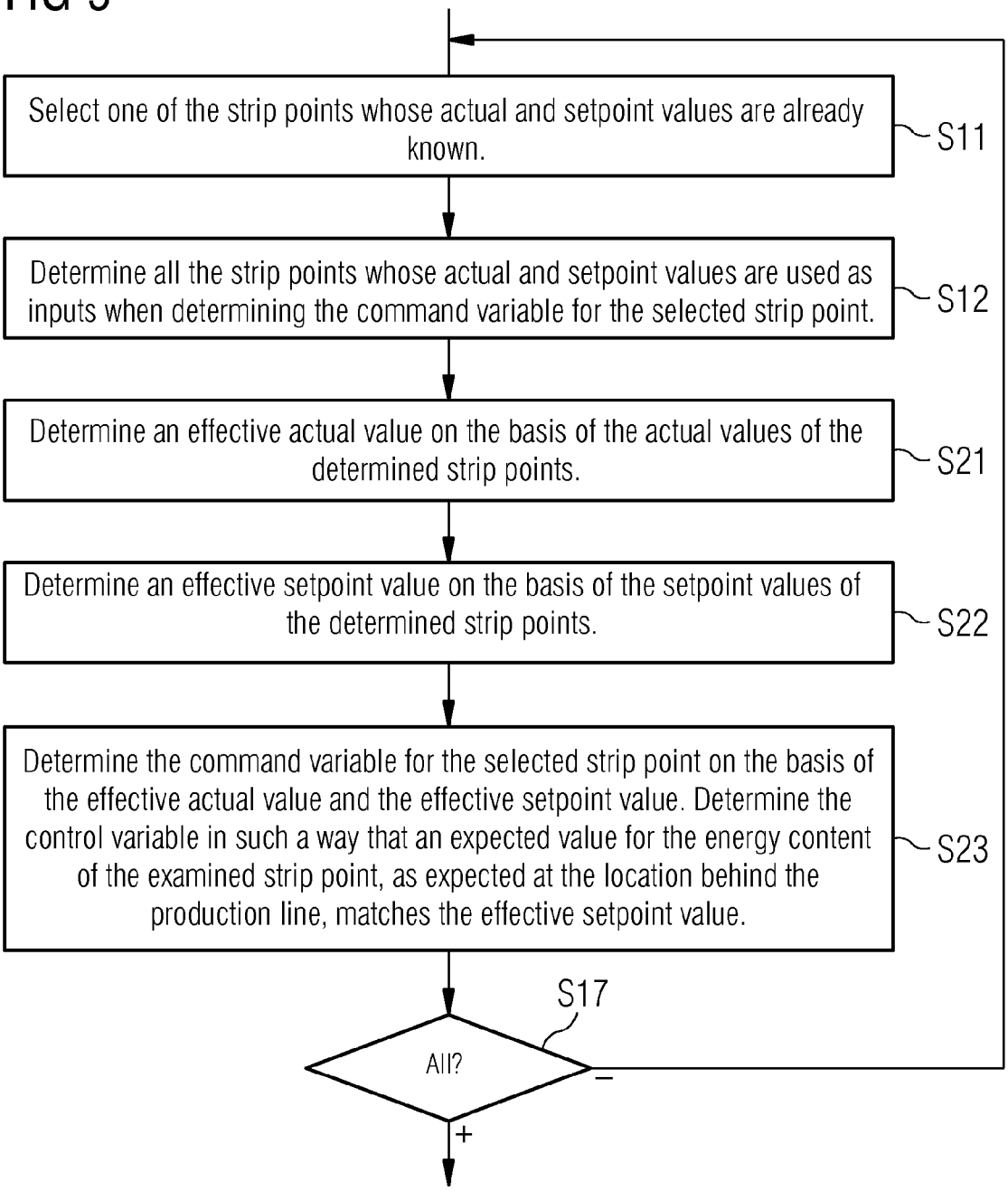

As an alternative to the procedure according to FIG. 8, it is possible as shown in FIG. 9 to replace the steps S13 to S16 from FIG. 8 with steps S21 to S23 as per FIG. 9. The steps S11, S12 and S17 in FIG. 8 are carried over from FIG. 8 into the procedure according to FIG. 9.

In the step S21, the control computer 8 determines an effective actual value G' based on the actual values G of the strip points 12, 13, 13' that were determined in the step S12. In the step S22, the control computer 8 similarly determines an effective setpoint value G'* based on the setpoint values G* of the strip points 12, 13, 13' that were determined in the step S12. For example, the control computer 8 can implement weighted or unweighted averaging in the steps S21 and S22. Irrespective of the procedure that is adopted, the procedures in steps S21 and S22 should nonetheless correspond to each other.

In the step S23, the control computer 8 determines the command variable L* for the strip point 12, 13 that was selected in the step S11.

The command variable L* that is determined in the step S23 corresponds to a corresponding command speed vL. If the strip point 12, 13 selected in the step S11 were to exhibit the effective actual value G' at the location xE, to which the actual value G of the strip point 12, 13 selected in the step S11 relates, and the control computer 8 were to operate the production line 1 at said command speed vL during the entire passage of the strip point 12, 13 selected in the step S11, an actual energy content that is characterized by an expected value GE would be expected for this strip point 12, 13 at the location xA, to which the setpoint value G* of the strip point 12, 13 selected in the step S11 relates. The control computer 8 determines the command variable L* in the step S23 such that the determined expected value GE matches the effective setpoint value G'*. In the same way as the procedure in step 14 according to FIG. 8, the expected value GE can be determined by means of a corresponding production line model that is known per se.

Figure 10:
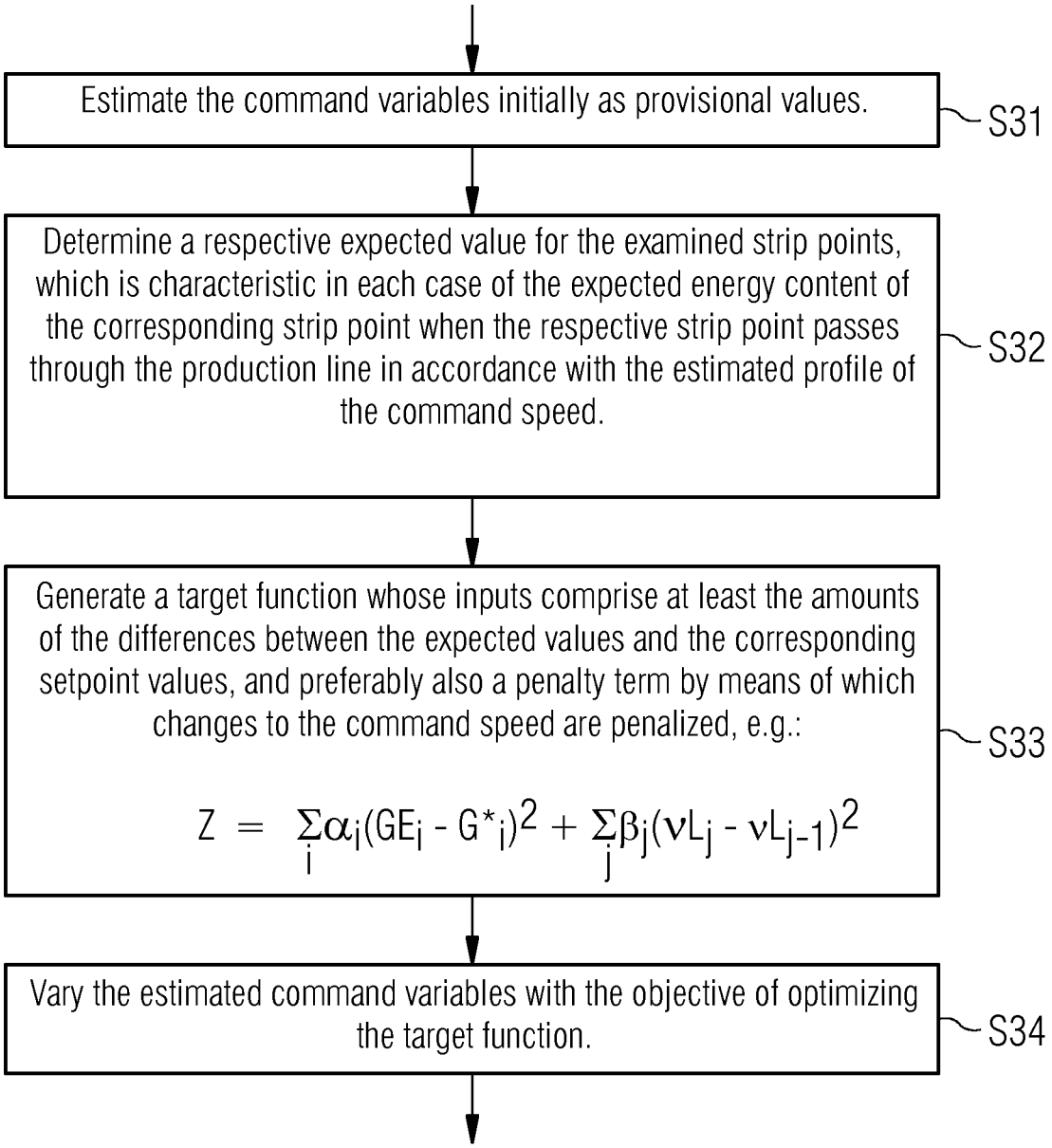

As an alternative to the procedures according to FIGS. 8 and 9, the command variables L* can be determined as per FIG. 10 as follows:

As shown in FIG. 10, in a step S31 the control computer 8 initially estimates the command variables L* that it is to determine (i.e. the command variables L* for the first strip point 12 and for at least a subset of the second strip points 13) as provisional values.

In a step S32, the control computer 8 determines a respective expected value GE for the strip points 12, 13 examined in the step S31. The expected values GE determined in the step S32 are characteristic in each case of that expected energy content, of the corresponding strip point 12, 13 in each case, which is expected for the respective strip point 12, 13 when the respective strip point 12, 13 passes through the production line 1 in accordance with the estimated profile of the command speed vL as defined by the sequence of the command variables L*. The expected energy contents GE relate in each case to that location xA to which the setpoint values G* for the strip points 12, 13 relate.

In a step S33, the control computer 8 generates a target function Z. The inputs for the target function Z comprise at least the amounts of the differences between the expected values GE and the corresponding setpoint values G*. The target function Z can contain a sum, for example, each summand being the square of the difference between an expected value GE and the corresponding setpoint value G* as per the illustration in FIG. 10.

The above described target function Z can be used in the way that has been described previously. However, the target function Z may have further input variables. In particular, a penalty term by means of which changes to the command speed vL are penalized can also be input into the target function Z. For example, the target function Z can therefore take the following form:

$$Z = \sum_i \alpha_i (GE_i - G_i^*)^2 + \sum_j \beta_j (vL_j - vL_{j-1})^2.$$

Different indices i, j are used in the two sums in this case because the indices i and j relate to different ranges. $\alpha_i$ and $\beta_j$ are weighting factors, being freely selectable in principle and not negative.

In a step S34, the control computer 8 varies the estimated command variables L* with the objective of optimizing the target function Z, i.e. minimizing it in accordance with the embodiment above. In the context of a corresponding different layout of the target function Z, maximizing would also be applicable.

The procedures in FIGS. 8 and 9 can be applied irrespective of whether, as a result of executing the steps S2 and S3 in FIG. 2 once, only a few command variables L* are determined or the command variables L* for all strip points 12, 13, 13' of the strip 2 are determined in advance. By contrast, the procedure according to FIG. 10 usually provides meaningful results only if the prediction horizon H covers the whole strip 2 or (provided the strip 2 is long enough) is sufficiently long. When using the procedure according to FIG. 10 in respect of a long strip 2, the prediction horizon H should be in particular so long that it corresponds at least to the effective length of the production line, and may be at least twice as long. The effective length of the production line is determined by the maximal number of strip points 12, 13, 13' situated in the production line 1 concurrently.

Expected values GE must be determined in the context of the procedure according to FIG. 8 and in the context of the procedure according to FIG. 9 and in the context of the procedure according to FIG. 10. The determination of the expected values GE is effected, in terms of approach, by means of a model of the production line 1, which models the thermal events (heat conduction and heat transmission, and possibly also phase conversion and structural formation) in the production line 1. Such models are known per se; see DE 103 21 791 A1.

Figure 11:
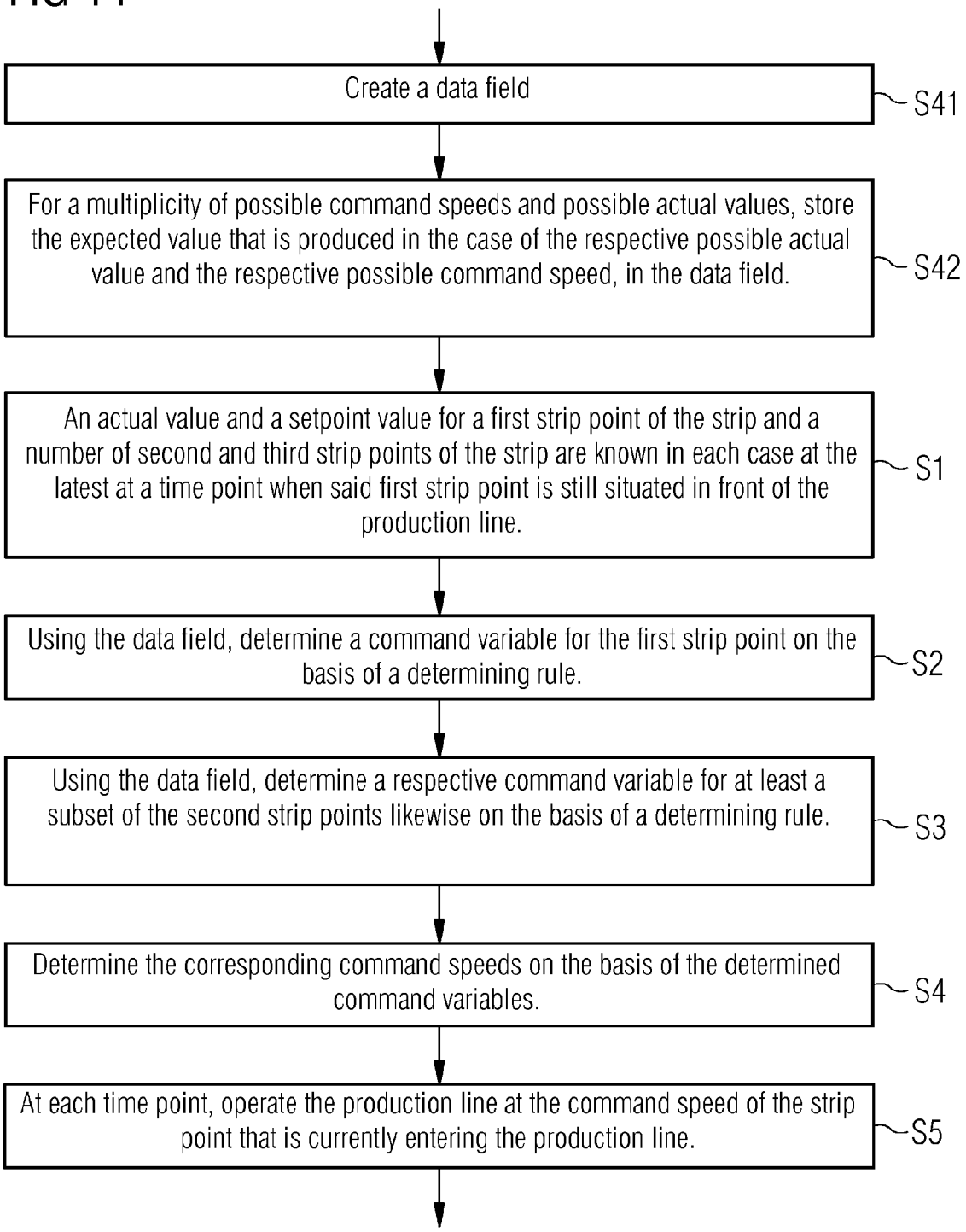

This type of model can also be used as such in the steps S14, S23 and S32. As per the illustration in FIG. 11, however, the control computer 8 may create a data field in advance in a step S41, i.e. before the command variables L* are determined. In a step S42, for a multiplicity of possible command speeds vL and possible actual values G, the control computer 8 stores the expected value GE that is produced in the case of the respective possible actual value G and the respective possible command speed vL, in the data field, as the control computer 8 can then determine the command variables L* for the strip points 12, 13 using the data field in the context of the correspondingly configured steps S2 and S3 from FIG. 2 (or the steps S14, S23 and S32). In the procedure according to FIG. 8, the control computer 8 determines the individual command variables l* using the data field, such that the use of the data field is indirect by nature. In the procedure according to FIG. 9, the respective command variable L* is determined directly. In the procedure according to FIG. 10, the data field is used to determine the expected values GE that are produced in each case.

Considerable acceleration can be achieved as a result of using the data field. Admittedly, the data field must also be determined in the context of a precalculation, i.e. when the hot strip 2 is already available for rolling in the production line 1. The data field cannot therefore be determined offline. Instead, the data field must be determined online, i.e. after the strip data has been specified to the control computer 8. Therefore only a few seconds are available for the purpose of determining the data field. Considerable acceleration is nonetheless achieved, as only relatively few values within the scope of the data field need to be fully examined by means of the model of the production line 1, e.g. for 10 possible actual values G and 10 possible command speeds vL in each case, such that the model calculation has to be performed for a total of 100 values. However, this is still considerably quicker than constantly determining the expected value GE for each individual strip point 12, 13, 13' subsequently by means of the model of the production line 1 in the context of the steps S14, S23, S32.

The way in which the data field is incorporated into the procedures according to FIGS. 8 and 9 is immediately apparent, since the actual value G is known to the control computer 8 and the relationship between the possible command speed vL and the expected value GE is that of one-to-one correspondence (the greater the command speed vL for a given actual value G, the greater the expected energy content of the corresponding strip point 12, 13, 13'). However, the data field can also be applied in connection with the procedure according to FIG. 10, as the average of all command variables G* and/or all command speeds vL for a specific strip point 12, 13, 13' can be generated in a first approximation, which is generally already very good, and used to operate the production line 1 during the passage of the relevant strip point 12, 13, 13' through the production line 1. This average can be taken as an effective command speed vL. The data field can therefore be evaluated at this point in order to determine the expected value GE for the corresponding strip point 12, 13, 13'.

The data field can be configured as required. For example, it can be a simple interpolation node field comprising e.g. 5, 8, 10, . . . interpolation nodes per dimension. Linear or non-linear interpolation (e.g. using splines) between individual interpolation nodes can be performed in this case. Alternatively, the data field can be configured as a neural network, for example.

If the actual value G is based on a measured value, e.g. captured by means of the temperature measuring device 14, the measured values can be processed directly. However, the location xE in front of the production line 1, to which the actual values G relate, is normally situated behind the temperature measuring device 14. It is therefore necessary to convert the measured values into the actual values G (which relate to the location xE). This is relatively easy, as only an air gap has to be calculated. Input values for the air gap are the temperature value that was measured by means of the temperature measuring device 14 and the time that is required by the respective strip point 12, 13, 13' before the corresponding strip point 12, 13, 13' reaches the location xE in front of the production line 1. The time for each strip point 12, 13, 13' is derived from the command speeds of the preceding strip points 12, 13, 13'.

This produces a feedback problem. In order to solve this problem, a provisional profile of the command speed vL is estimated initially. Assuming that this estimated profile is suitable, the actual values G relating to the location xE in front of the production line 1 are determined. Using the actual values G that have now been determined, the profile of the command speed vL is determined. The determined profile of the command speed vL is in turn used to determine the actual values G again. In practice, the procedure converges very quickly. Only a few iterations, e.g. three to five iterations, are usually required to achieve sufficiently stable results.

In the context of the foregoing explanations of the present disclosure, it has been assumed that the production line 1 features neither an input-side heating device 4 nor inter-stand cooling devices 5. If the heating device 4 and/or the inter-stand cooling devices 5 are present, the operating method can be adapted accordingly. The necessary adaptations are explained below in connection with a single inter-stand cooling device 5. However, the corresponding explanations are also readily applicable to embodiments of the production line 1 having more than one inter-stand cooling device 5 and/or one input-side heating device 4, wherein the heating device 4 may be present as an alternative to or in addition to the inter-stand cooling devices 5.

Figure 12:
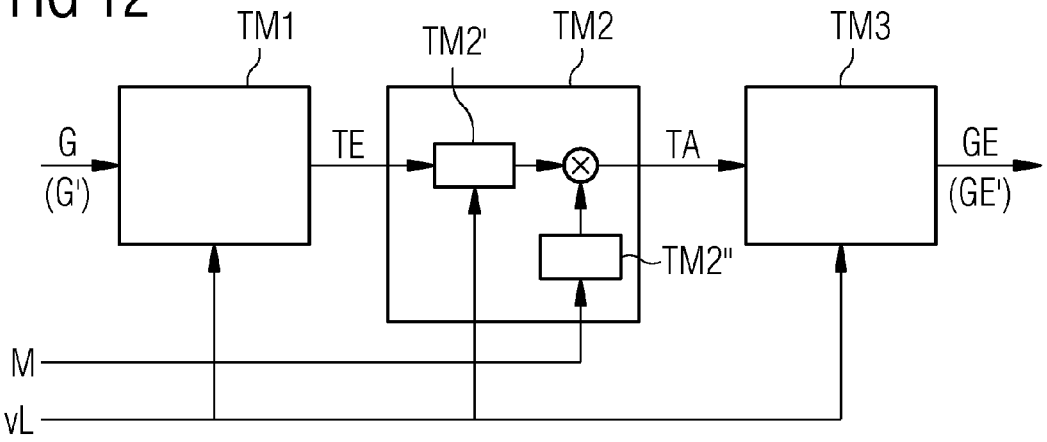
FIG. 12 shows a model of the production line.

Let it therefore be assumed that the production line 1 features a single inter-stand cooling device 5, e.g. between the second and the third roll stand 3 according to the illustration in FIG. 1. In this case, it is immediately apparent that the model of the production line 1 can be divided into three partial models, which are designated partial model TM1, partial model TM2 and partial model TM3 in FIG. 12.

In terms of approach, the partial model TM1 corresponds to a model of a production line 1 as assumed previously, i.e. a model of a production line 1 without inter-stand cooling devices. It models the behavior of the strip 2 in the production line 1 as far as the inter-stand cooling device 5. The partial model TM1 receives the actual value G of a strip point 12, 13, 13' and its command speed vL or the corresponding command-speed profile as input variables. The partial model TM1 delivers an output variable in the form of an expected value TE, which corresponds to an expected energy content of the corresponding strip point 12, 13, 13' when this is fed into the inter-stand cooling device 5. The partial model TM1 is two-dimensional, since it has two input variables, namely the actual value G and the command speed vL. The partial model TM2 models the inter-stand cooling device 5 itself. As input variables, it receives the expected value TE that is delivered from the partial model TM1, the command speed vL at which the relevant strip point 12, 13, 13' passes through the inter-stand cooling device 5, and a given coolant volume M to which the strip 2 is exposed per time unit. The coolant volume M per time unit may be defined as a function of that material volume of the strip 2 which has already passed through the inter-stand cooling device 5. Alternatively, the coolant volume M per time unit can be defined e.g. as a function of the relevant strip point 12, 13, 13' that is currently feeding into the inter-stand cooling device 5.

Unlike a model of a production line 1 without inter-stand cooling devices, the partial model TM2 therefore has three input variables. The creation of a corresponding three-dimensional data field for the three-dimensional partial model TM2 is still possible depending on the computing power available. However, the partial model TM2 may be split into two submodels TM2', TM2" that are multiplicatively associated, as a three-dimensional function f that specifies an expected value TA behind the inter-stand cooling device 5 as a function of the expected value TE in front of the inter-stand cooling device 5, the command speed vL and the coolant volume M per time unit, can be represented with sufficient accuracy as the product of a two-dimensional function g and a one-dimensional function h. The function g here is dependent on the expected value TE (which is supplied by the partial model TM1) and the command speed vL. The function h is dependent only on the coolant volume M per time unit. It therefore applies that $$TA=f(TE,vL,M)=g(TE,vL)\cdot h(M)$$

where

TA designates the expected value for the energy content of the examined strip point 12, 13, 13' behind the inter-stand cooling device 5, TE designates the expected value for the energy content of the examined strip point 12, 13, 13' in front of the inter-stand cooling device 5, vL designates the command speed, and M designates the volume of coolant that is deposited onto the strip 2 per time unit.

In terms of approach, the partial model TM3 has the same structure as the partial model TM1. It models that part of the production line 1 which is arranged behind the inter-stand cooling device 5.

The partial models TM1 to TM3 are interconnected and concatenated such that the output variables of the one partial model TM1, TM2 represent input variables of the next model TM2, TM3 respectively. By virtue of said concatenation of the partial models TM1 to TM3, it is already possible significantly to reduce the dimensionality of the modeling problem, specifically to the examination of one three-dimensional problem and two two-dimensional problems. As a result of splitting the three-dimensional problem (i.e. the partial model TM2) into one one-dimensional and one two-dimensional function, the complexity can be reduced further. In particular, this reduction in the complexity of the three-dimensional problem allows the realtime and online capability to be maintained even when the inter-stand cooling devices 5 and/or the heating device 4 are present.

If the inter-stand cooling devices 5 and/or the heating device 4 are present, it is therefore possible to calculate the command variables L* assuming that the profile of the coolant volume M per time unit is given. In a second step, using the profile of the command variables L* that is now known, it is then possible to vary the volume M for each inter-stand cooling device 5, in order to approximate the expected energy contents of the strip points 12, 13, 13' as far as possible to the corresponding setpoint energy contents of the strip points 12, 13, 13'. The determination of the correct volumes M is similar in every respect to the determination of the correct volumes of coolant for the cooling devices 7 of the cooling section 6.

It is possible for the control computer 8 to control the production line 1 without capturing a measured value GM that is characteristic of the actual energy content of the strip points 12, 13, 13' behind the production line 1. However, in one embodiment and obviously after the respective strip points 12, 13, 13' have passed through the production line 1 in this case, the control computer 8 receives a corresponding measured value GM in each case for the corresponding strip points 12, 13, 13' in a step S51 as per FIG. 13. For example, the control computer 8 can receive a corresponding temperature measured value that was captured by means of the temperature measuring device 15.

Figure 13:
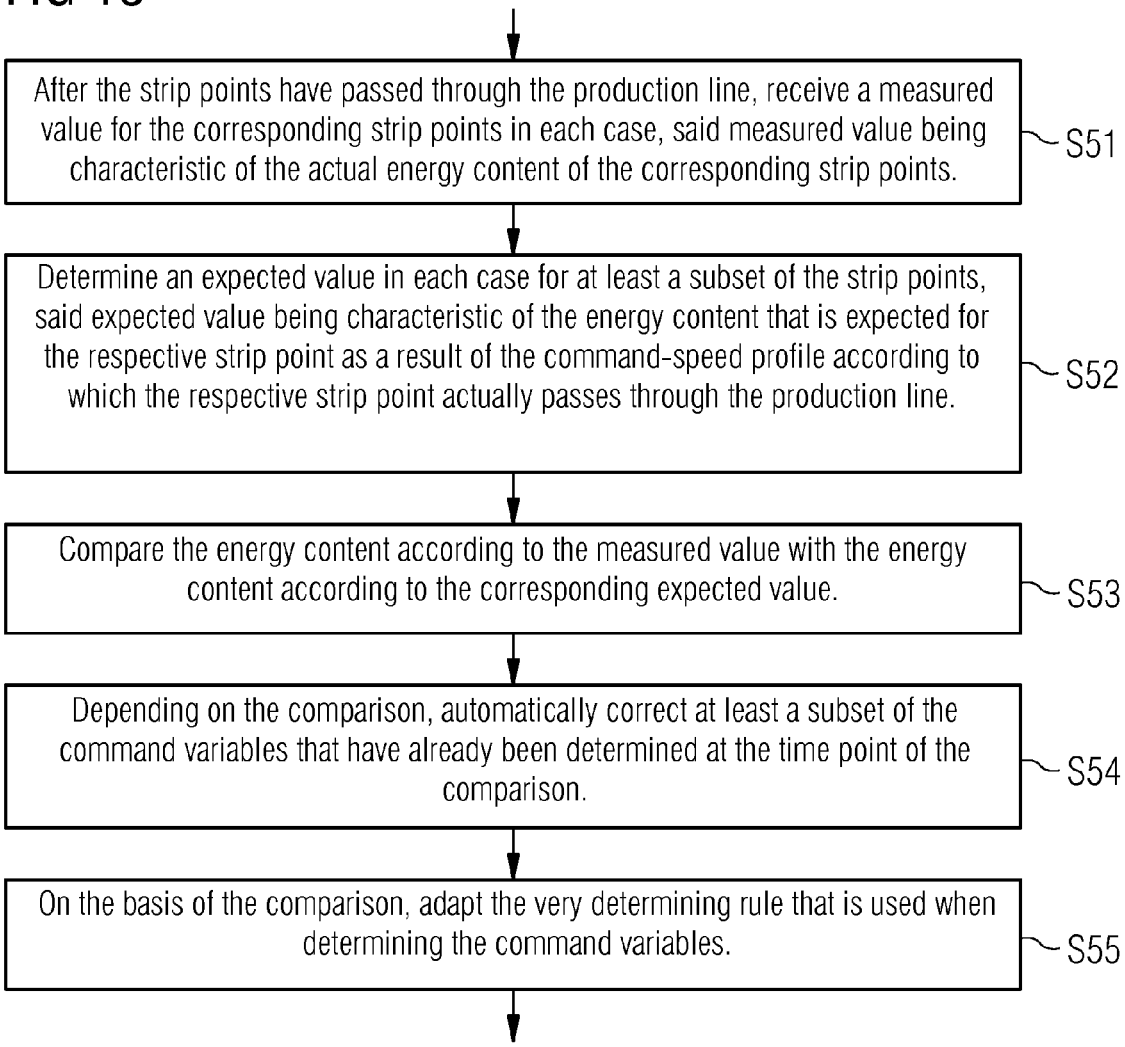
FIG. 13 shows a flow diagram.

Furthermore, in a step S52 according to FIG. 13, the control computer 8 determines an expected value GE' in each case for at least a subset of the strip points 12, 13, 13', or for all of the strip points 12, 13, 13'. As a rule, the control computer 8 determines the relevant expected value GE' for each strip point 12, 13, 13' while the respective strip point 12, 13, 13' is passing through the production line 1. However, it is alternatively possible for the control computer 8 to determine the corresponding expected value GE' before the respective strip point 12, 13, 13' passes through the production line 1. Each such determined expected value GE' is characteristic of the energy content that is expected for the respective strip point 12, 13, 13' at the location xA to which the setpoint values G* relate. The control computer 8 determines the expected values GE' using the command-speed profile according to which the respective strip point 12, 13, 13' actually passes through the production line 1.

If the model of the production line 1 is error-free, irrespective of the precise type of model of the production line 1, the actual energy contents of the strip points 12, 13, 13' as determined in the step S52 correspond exactly to the actual energy contents that are specified by the corresponding measured values GM. In many cases, however, the model of the production line 1 is erroneous. The reasons for this can be very varied. For example, the modeling may be based on excessively simple estimates or the model may have a systematic error such as e.g. incorrect modeling of the heat transmission. In a step S53, the control computer 8 therefore compares the energy content according to the measured value GM with the energy content according to the corresponding expected value GE'. Depending on the comparison in the step S53, a step S54 provides for the control computer 8 automatically to correct at least a subset of the command variables L* that the control computer 8 has already determined at the time point of the comparison.

Within the context of step S54, the correction of the command variables L* obviously relates only to those command variables L* which have already been determined but have not yet been implemented at this time point. The step S54 is therefore only carried out for command variables L* that have been determined for strip points 12, 13 which have not yet been fed into the production line 1 at the time point of the correction.

It is possible for all of the corrected command variables L* to be immediately corrected to the full extent. However, a gradual transition may be preferred. For example, the first corrected command variable L* can be corrected by 10% of its change, the second corrected command variable by 20% of its change, the third corrected command variable L* by 30% of its change, etc.

Alternatively or in addition to the inclusion of the step S54, provision can be made in a step S55 for the control computer 8, based on the comparison, to adapt the very determining rule that is used to determine the command variables L*. This results in an improved determination of command variables L* that will be determined in the future and have not yet been determined at the time point of the comparison in the step S53. The adaptation of the determining rule can comprise in particular an adaptation of the model of the production line 1, and of the heat transmission model in particular here.

In particular, if the expected values GE, GE' are determined by means of the data field cited above, the adaptation of the model of the production line 1 can be performed in a simple manner for the strip 2 that is currently passing through the production line 1, as in this case the adaptation can be effected e.g. by adding an offset to the actual values G before they are used as input variables of the data field. Alternatively or in addition to this, the command speed vL can be scaled using a factor and/or an offset can be added to it before it is used as an input variable of the data field. Alternatively or in addition to this, an offset can be added to the expected value GE, GE' that is determined using the data field in each case. In particular, the realtime capability of the operating method is maintained when using this simplified manner of adapting the model of the production line 1.

In the context of the step S54, it is possible to correct all of the command variables L* that have already been determined but have not yet been implemented at this time point, thus including the command variable L* for the (first) strip point 12 that will enter the production line 1 next, for example. However, provision may be made for the control computer 8, based on the comparison in the step S53, automatically to correct only those command variables L* which were determined for (second) strip points 13 that have a minimal distance MIN (see FIG. 14) from the entrance of the production line 1 at the time point of the correction.

Figure 14:
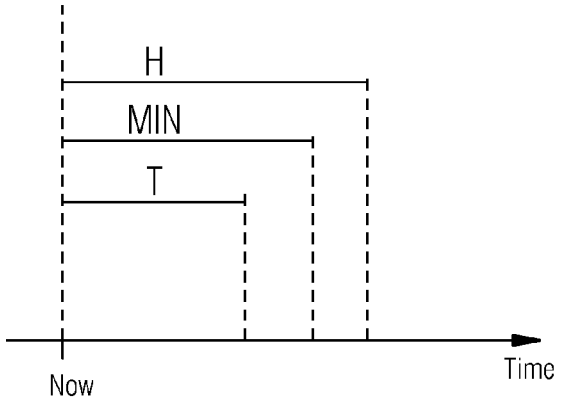
FIG. 14 shows a time diagram.

As illustrated in FIG. 14, the operating method has a prediction horizon H in relation to the command-variable profile. The prediction horizon H is specified by the second strip point 13 whose command variable L* has already been determined and which, of the second strip points 13 whose command variables L* have already been determined, is farthest from the production line 1. It can be beneficial if the control computer 8, based on the comparison, automatically corrects only those command variables L* which have been determined for the second strip points 13 that have the minimal distance MIN from the entrance of the production line 1 at the time point of the correction. This is explained below with reference to FIG. 7.

According to the illustration according to FIG. 7,

- the strip points P1 to P4 have already left the production line 1,
- the strip points P5, P6, P7, . . . P30 are situated in the production line 1,
- the strip point P31 is the next to enter the production line 1, and
- the prediction horizon H, starting from the strip point P31, extends to the strip point P35.

Based on the actual temperature of the strip point P2 in front of the production line 1, for example, and based on the profile of the command-speed at which the strip point P2 passed through the production line 1, the control computer 8 determines the temperature that is expected for the strip point P2 at the exit of the production line 1 (i.e. at the location xA). This corresponds to the step S52 from FIG. 13. The control computer 8 also receives the actual temperature that is measured for the strip point P2, from the temperature measuring device 15. This corresponds to the step S51 from FIG. 13. Let it be assumed that the comparison in the step S53 reveals a deviation. In spite of the deviation, for example, the control computer 8 leaves the previously determined command variables L* for the strip points P31 to P34 unchanged. Based on the comparison in the step S53, it corrects only the command variable L* of the strip point P35 in the step S54. The command variables L* for subsequent strip points P36, P37, . . . , which have not yet been determined at this time point, are determined by the control computer 8 based on a determining rule that it adapts in the step S55 based on the comparison in the step S53.

It may still be permitted in specific cases also to change the command variables L* of the strip points P31 to P34. In this case, the modification of the corresponding command variables L* is not performed based on the comparison in the step S53, however, but based on a supervisory control intervention that is specified to the control computer 8 by a different control device, e.g. the control device 8', or by an operator.

As mentioned above, a cooling section 6 is usually arranged behind the production line 1. The cooling section 6 comprises cooling devices 7. Each cooling device has at least one control valve 7' and a number of spray nozzles 7" that are assigned to the respective control valve 7'. The quantity of cooling liquid that is released locally onto the strip 2 is adjusted by means of the respective control valve 7'. The control valves 7' react relatively slowly. Between the time point at which a control valve 7' is activated using a modified actuating variable S, and the time point at which the modified activation has an effect on the strip 2, there is a dead time T that often measures several seconds. Dead times of two to five seconds are perfectly normal. Furthermore, the profile of the command speed vL also influences the throughput time of the strip points 12, 13, 13' through the cooling section 6. Therefore the control device 8', which performs the activation of the cooling devices 7 of the cooling section 6, must know not only the momentary value of the command speed vL, but also its future profile, as only then can the control device 8' of the cooling section 6 react at the correct time in advance to any changes in the command speed vL that may apply in the future. The control device 8' of the cooling section 6 must therefore use the command variable L*, and indeed any command variables L* that may apply in the future, to determine the actuating variables S for the control valves 7' if the correct coolant volumes are to be deposited at the "correct" positions on the strip 2. This obviously also applies analogously if the control of the cooling section 6 is performed by the control computer 8.

In the event that inter-stand cooling devices 5 are present, similar dead times occur at the inter-stand cooling devices 5. Therefore the command-variable profile should also be used here when determining the actuating variables S for the inter-stand cooling devices 5, such that it is possible to react at the correct time in advance to any changes in the command speed vL that may apply in the future. Therefore the prediction horizon H according to FIG. 14 may be at least as long as the dead time T described above. The prediction horizon H may be even longer than the dead time T. If the dead time T corresponds to the strip points P31 to P33 as per FIG. 7, for example, the prediction horizon H should extend over more than two strip points, e.g. over four strip points as per the illustration in FIG. 7.

For essentially the same reasons, the minimal distance MIN, within which the correction of the command variables L* is suppressed, should be at least as long as the dead time T, e.g. three strip points as per FIG. 7.

In terms of approach, the command variables L* are determined at specific points for the individual strip points 12, 13. When determining a continuous command-speed profile, the step S4 is developed in the form of a step S61 according to FIG. 15. In the step S61, the control computer 8 concatenates the determined command variables L* by means of a spline, whereby the concatenation produces a command-variable profile that is constant and differentiable. The corresponding command-speed profile determined thus is also constant and differentiable.

A step S62 could be provided as an alternative to the step S61. In the step S62, the control computer 8 determines the corresponding command speeds vL at specific points based on the command variables L* that are determined at specific points. In this case, the control computer 8 concatenates the corresponding command speeds vL by means of a spline, such that a constant and differentiable command-speed profile is produced by the concatenation.

Figure 15:
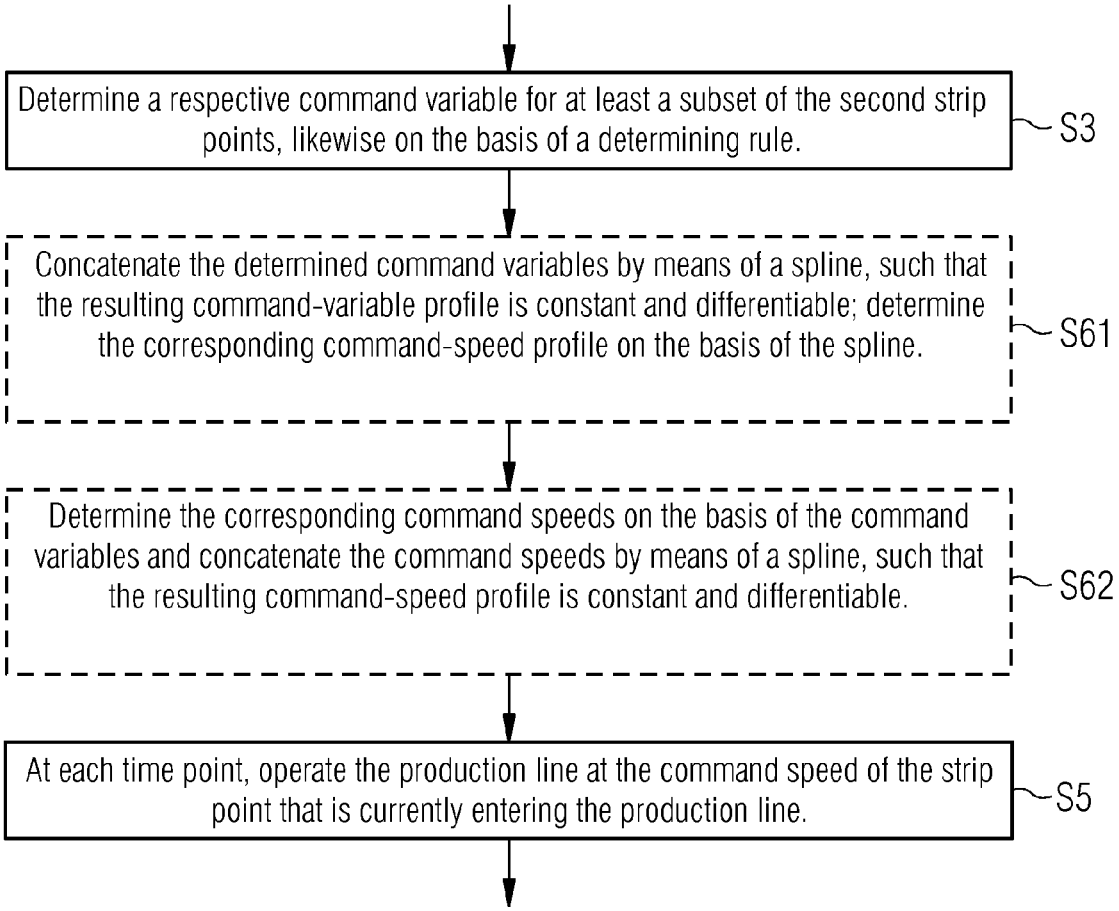
FIG. 15 shows a flow diagram.

The steps S61 and S62 represent alternatives. Although both are shown in FIG. 15, they are therefore both marked only by a broken line.

The above described operating method for the production line 1 (initially) supplies command speeds vL until the last strip point 13 of the strip 2 has been fed into the production line 1. However, the command speed vL must continue to be defined for as long as at least one strip point 12, 13 is situated in the production line 1, even if no further strip points 12, 13 are being fed into the production line 1. The procedure can easily be extended accordingly. For this purpose, in addition to the strip points 12, 13, 13' relating to the physical strip 2, provision is simply made for virtual strip points to be taken into consideration within the control computer 8, said virtual strip points being appended to the first-cited strip points. A corresponding command variable L* is also determined for these virtual strip points. However, neither an actual value G nor a setpoint value G* is assigned to the virtual strip points, and therefore the virtual strip points themselves do not contribute to the determination of the corresponding command variables L*.

In the context of the explanation of the present disclosure, the command variable L* has been explained in each case with reference to the strip points 12, 13 that are fed into the production line 1 at specific time points. However, this does not mean that the corresponding command variables L* are permanently assigned to the corresponding strip points 12, 13, as the corresponding command variable L* acts globally on the entire strip 2. Of critical importance is solely therefore the assignment of the respective command variable L* to a specific time point, said time point being defined as that time point at which the corresponding strip point 12, 13 is fed into the production line 1.

Embodiments of the present disclosure may provide various advantages. for example, it may allow the prediction of a command-variable profile or command-speed profile that is actually also maintained subsequently during the operation of the production line 1. This is associated with improved accuracy in the maintenance of the setpoint energy content on the delivery side of the production line 1, and with improved accuracy (even significantly improved accuracy) in the control of the cooling section 6. It is thus possible to maintain both a final rolling temperature (on the delivery side of the production line 1) and a coiler temperature (on the delivery side of the cooling section 6) with great accuracy.

The foregoing description serves merely to explain the present invention. The scope of protection of the present invention is defined exclusively by the appended claims.

What is claimed is:

1. An operating method for a production line for rolling a strip, the method comprising:

at a time point before a first strip point of the strip is fed into the production line, a control computer of the production line receiving an actual value and a setpoint value for each of the first strip point, a number of second strip points, and a number of third strip points of the strip, wherein for each first, second, and third strip point, the respective actual value describes energy content of that strip point either by temperature or enthalpy, and the respective setpoint value is a setpoint for the energy content of that strip point, wherein for each first, second, and third strip point, the respective actual value relates to a location in front of the production line and the respective setpoint value relates to a location behind the production line, feeding the third strip points into the production line, followed by the first strip point, followed by the second strip points, prior to feeding the first strip point into the production line, the control computer determining a command variable for each of the first strip point and at least a subset of the second strip points based on a determining rule specific to the respective strip point, wherein each respective command variable is characteristic of a command speed at which the control computer operates the production line at a time when the respective strip point is fed into the production line, and the control computer determining the respective command speed for each respective strip point based on the command variable determined for that strip point, and the control computer operating the production line at the respective command speed at the time when the respective strip point is fed into the production line, wherein the determining rule for determining each respective command variable is determined based at least on (a) the actual value and the setpoint value of the respective strip point currently entering the production line, and (b) the actual value and the setpoint value of at least one strip point that has already entered the production line, wherein for each of at least a subset of the strip points, the control computer:

determines a respective expected value of the temperature or enthalpy of an expected energy content that is expected for the respective strip point, at a location behind the production line to which the currently corresponding setpoint value relates, as a result of the command speeds at which the control computer operates the production line during the entire passage of the respective strip point through the production line, receives, after the passage of the respective strip point through the production line, a measured value of the temperature or enthalpy of an actual energy content of the respective strip point at the location behind the production line to which the corresponding setpoint value relates, and automatically corrects the command variable determined for the respective strip point based on a comparison between the expected energy content and the actual energy content wherein based on the comparison, the control computer automatically corrects only those command variables that were determined for the strip points having a minimal distance from the entrance to the production line at the time point of the correction.

2. The operating method of claim 1, wherein the control computer determines each of the command variables based on a multiplicity of individual command variables, wherein each individual command variable relates to one of the strip points whose actual value and setpoint value are input into the determination of the respective command variable, wherein the control computer determines the command variable for each strip point such that a respective expected value matches the corresponding setpoint value, and wherein the respective expected value is either the temperature or enthalpy representing the energy content that the respective strip point would reach, at a location behind the production line to which the currently corresponding setpoint value relates, if the control computer were to operate the production line at a command speed corresponding to the individual command variable during the entire passage of the respective strip point through the production line.

3. The operating method of claim 2, wherein:

the control computer creates a data field in which, for multiple possible command speeds and possible actual values, the control computer stores the expected value that is produced for the respective possible actual value in the case of the respective possible command speed, and the control computer determines the command variables for the strip points using the data field.

4. The operating method of claim 3, wherein the control computer:

determines, for at least a subset of the strip points, a respective expected value of the temperature or enthalpy of an expected energy content that is expected for the respective strip point, at a location behind the production line to which the currently corresponding setpoint value relates, as a result of the command speeds at which the control computer operates the production line during the entire passage of the respective strip point through the production line, receives, after the passage of the respective strip point through the production line, a measured value of the temperature or enthalpy of an actual energy content of the respective strip point at that location behind the production line to which the corresponding setpoint value relates, automatically adapts a model of the production line based on a comparison between the expected thermal energy content and the actual thermal energy content, and adapts the model of the production line by adding an offset to the actual values when the data field is used, scaling the command speeds using a scaling factor and/or adding an offset to said command speeds and/or adding an offset to the expected values that were determined using the data field.

5. The operating method of claim 1, wherein for each strip point whose command variable is determined by the control computer, said control computer:

determines an effective actual value based on the actual values that used in the determination of the command variable for the respective strip point, and determines an effective setpoint value based on the setpoint values used in the determination of the command variable for the respective strip point, determines an expected value of the temperature or enthalpy of an expected energy content which the respective strip point would reach, at that location behind the production line to which the effective setpoint value relates, if the control computer were to operate the production line at a command speed corresponding to the command variable for the respective strip point during the entire passage of the respective strip point through the production line, and determines the command variable such that the expected value at that location behind the production line to which the effective setpoint value relates has the effective setpoint value.

6. The operating method of claim 1, wherein when determining the command variables, the control computer initially determines estimated command variables as provisional values, wherein the control computer determines a respective expected value for the first strip point and at least a subset of the second and third strip points, wherein each expected value is either the temperature or enthalpy of an expected energy content that the respective strip point would reach, at that location behind the production line to which the currently corresponding setpoint value relates, if the control computer were to operate the production line at command speeds corresponding to the estimated command variables during the entire passage of the respective strip point through the production line, and wherein the control computer varies the estimated command variables, thereby optimizing a target function into which the amounts of the differences between the expected values and the corresponding setpoint values are input.

7. The operating method of claim 6, wherein a penalty term by means of which changes to the command speed are penalized is additionally input into the target function.

8. The operating method of claim 1, wherein for each command variable, the actual value and the setpoint value of those strip points that have already entered the production line are only used in the determination of that command variable if these strip points have not yet left the production line at the time at which that respective command variable is determined.

9. The operating method of claim 1, wherein the control computer or another control device uses at least one of the command variables to determine at least one further actuating variable, wherein said further actuating variable is delayed by a dead time and acts only locally on the strip, and wherein the minimal distance is specified such that a time difference corresponding to the minimal distance is at least as long as the dead time.

10. The operating method of claim 1, wherein the control computer or another control device uses at least one of the command variables to determine at least one further actuating variable, wherein said further actuating variable is delayed by a dead time and acts only locally on the strip, and wherein the first strip point and that subset of the second strip points for which a particular command variable was determined before the first strip point was fed into the production line correspond to a prediction horizon that is at least as long as the dead time.

11. The operating method of claim 1, wherein the control computer concatenates the determined command variables or the corresponding command speeds by means of a spline, such that a command-speed profile produced by the concatenated command variables or command speeds is constant and differentiable.

12. The operating method of claim 1, wherein the control computer performs the determination of the command variables in a context of a precalculation online or in real time.

13. A computer program for use by a control computer of a production line, the computer program being stored in non-transitory computer-readable media and executable by a processor to: at a time point before a first strip point of the strip is fed into the production line, receive an actual value and a setpoint value for each of the first strip point, a number of second strip points, and a number of third strip points of the strip, wherein for each first, second, and third strip point, the respective actual value describes an energy content of that strip point either by temperature or enthalpy, and the respective setpoint value is a setpoint for the energy content of that strip point, wherein for each first, second, and third strip point, the respective actual value relates to a location in front of the production line and the respective setpoint value relates to a location behind the production line, feed the third strip points into the production line, followed by the first strip point, followed by the second strip points, prior to feeding the first strip point into the production line, determine a command variable for each of the first strip point and at least a subset of the second strip points based on a determining rule specific to the respective strip point, wherein each respective command variable is characteristic of a command speed at which the control computer operates the production line at a time when the respective strip point is fed into the production line, and determine the respective command speed for each respective strip point based on the command variable determined for that strip point, and the control computer operating the production line at the respective command speed at the time when the respective strip point is fed into the production line, wherein the determining rule for determining each respective command variable is determined based at least on (a) the actual value and the setpoint value of the respective strip point currently entering the production line, and (b) the actual value and the setpoint value of at least one strip point that has already entered the production line, wherein for each of at least a subset of the strip points, the control computer:

determines a respective expected value of the temperature or enthalpy of an expected energy content that is expected for the respective strip point, at a location behind the production line to which the currently corresponding setpoint value relates, as a result of the command speeds at which the control computer operates the production line during the entire passage of the respective strip point through the production line, receives, after the passage of the respective strip point through the production line, a measured value of the temperature or enthalpy of an actual energy content of the respective strip point at the location behind the production line to which the corresponding setpoint value relates, and automatically corrects the command variable determined for the respective strip point based on a comparison between the expected energy content and the actual energy content wherein based on the comparison, the control computer automatically corrects only those command variables that were determined for the strip points having a minimal distance from the entrance to the production line at the time point of the correction.

* * * * *